US009920704B2

(12) United States Patent
Katsurahara et al.

(10) Patent No.: US 9,920,704 B2
(45) Date of Patent: Mar. 20, 2018

(54) FUEL INJECTION CONTROL SYSTEM OF INTERNAL COMBUSTION ENGINE

(71) Applicant: DENSO CORPORATION, Kariya, Aichi-pref (JP)

(72) Inventors: Hiroshi Katsurahara, Kariya (JP); Nobuyuki Satake, Kariya (JP); Keisuke Yanoto, Kariya (JP)

(73) Assignee: DENSO CORPORATION, Kariya (JP)

( * ) Notice: Subject to any disclaimer, the term of this patent is extended or adjusted under 35 U.S.C. 154(b) by 151 days.

(21) Appl. No.: 15/027,334

(22) PCT Filed: Oct. 7, 2014

(86) PCT No.: PCT/JP2014/005097
§ 371 (c)(1),
(2) Date: Apr. 5, 2016

(87) PCT Pub. No.: WO2015/052916
PCT Pub. Date: Apr. 16, 2015

(65) Prior Publication Data

US 2016/0252035 A1 Sep. 1, 2016

(30) Foreign Application Priority Data

Oct. 11, 2013 (JP) ..... 2013-214126
Sep. 23, 2014 (JP) ..... 2014-193186

(51) Int. Cl.
*F02D 41/00* (2006.01)
*F02D 41/24* (2006.01)
(Continued)

(52) U.S. Cl.
CPC ..... *F02D 41/247* (2013.01); *F02D 41/1402* (2013.01); *F02D 41/20* (2013.01);
(Continued)

(58) Field of Classification Search
CPC ..... F02D 41/247; F02D 41/1402; F02D 41/2467; F02D 41/20; F02D 2200/0616;
(Continued)

(56) References Cited

U.S. PATENT DOCUMENTS 4,438,496 A * 3/1984 Ohie ..... F02D 41/14 123/458
5,878,722 A * 3/1999 Gras ..... F02D 41/20 123/506

(Continued)

FOREIGN PATENT DOCUMENTS

JP 2010-073705 4/2010
JP 2010-532448 10/2010

OTHER PUBLICATIONS

Katsurahara, U.S. Appl. No. 15/027,330, filed Apr. 5, 2016.
Katsurahara et al., U.S. Appl. No. 15/027,335, filed Apr. 5, 2016.

*Primary Examiner* — David Hamaoui
*Assistant Examiner* — Sherman Manley
(74) *Attorney, Agent, or Firm* — Nixon & Vanderhye P.C.

(57) ABSTRACT

At least after off of an injection pulse of partial lift injection, a difference between a first filtered voltage being a negative terminal voltage of a fuel injection valve filtered by a first low-pass filter and a second filtered voltage being the terminal voltage filtered by a second low-pass filter is calculated, and time from a predetermined reference timing to a timing when the difference between the filtered voltages has an inflection point is calculated as voltage inflection time. Subsequently, an injection quantity corresponding to current voltage inflection time is estimated for each of injection pulse widths with a relationship between the voltage inflection time and the injection quantity, the relationship being beforehand stored for each of the injection pulse widths. A map defining the relationship between the injection pulse width and the injection quantity is created based (Continued)

on a result of such estimation, and a required injection pulse width corresponding to a required injection quantity is calculated using the map.

18 Claims, 29 Drawing Sheets

(51) Int. Cl.
*F02D 41/20* (2006.01)
*F02D 41/14* (2006.01)

(52) U.S. Cl.
CPC .. *F02D 41/2467* (2013.01); *F02D 2041/1432* (2013.01); *F02D 2041/2051* (2013.01); *F02D 2041/2055* (2013.01); *F02D 2200/0616* (2013.01)

(58) Field of Classification Search
CPC ..... F02D 2041/2055; F02D 2041/2051; F02D 2041/1432
See application file for complete search history.

(56) References Cited

U.S. PATENT DOCUMENTS 6,192,855 B1 * 2/2001 Schietecatte ..... F02D 41/1497 123/299
6,213,099 B1 * 4/2001 Calvas ..... F02D 41/20 123/490
7,522,987 B2 * 4/2009 Fujii ..... F02D 41/1497 123/486
2003/0071613 A1 4/2003 Schultz et al.
2008/0009999 A1 * 1/2008 Sugiyama ..... F02D 41/2438 701/103
2016/0076498 A1 * 3/2016 Aono ..... F02D 41/20 123/490
2016/0245211 A1 * 8/2016 Katsurahara ..... F02D 41/20
2016/0252035 A1 * 9/2016 Katsurahara ..... F02D 41/20 123/478
2016/0252037 A1 * 9/2016 Katsurahara ..... F02D 41/20 123/480
2016/0281629 A1 * 9/2016 Moriya ..... F02D 41/2467
2016/0363075 A1 * 12/2016 Larocca ..... F02D 41/1456

* cited by examiner

FUEL INJECTION CONTROL SYSTEM OF INTERNAL COMBUSTION ENGINE

CROSS REFERENCE TO RELATED APPLICATION

This application is the U.S. national phase of International Application No. PCT/JP2014/005097 filed Oct. 7, 2014, which designated the U.S. and claims priority to Japanese Patent Applications No. 2013-214126 filed on Oct. 11, 2013, and No. 2014-193186 filed on Sep. 23, 2014, the entire contents of each of which are hereby incorporated herein by reference.

TECHNICAL FIELD

The present disclosure relates to a fuel injection control system of an internal combustion engine having an electromagnetic driving fuel injection valve.

BACKGROUND ART

Generally, a fuel injection control system of an internal combustion engine includes an electromagnetic driving fuel injection valve, and calculates a required injection quantity in correspondence to an operation state of the internal combustion engine, and drives the fuel injection valve to open with an injection pulse having a width corresponding to the required injection quantity so that fuel corresponding to the required injection quantity is injected.

For a fuel injection valve of an in-cylinder injection type internal combustion engine injecting high-pressure fuel into a cylinder, however, as illustrated in FIG. 5, linearity of a variation characteristic of an actual injection quantity relative to an injection pulse width tends to be reduced in a partial lift region (a region of a partial lift state, or a region of a short injection pulse width allowing a lift amount of a valve element not to reach a full lift position). In the partial lift region, the lift amount of the valve element (for example, a needle valve) tends to greatly vary, leading to a large variation in injection quantity. Such a large variation in injection quantity may degrade exhaust emission or drivability.

An existing technique on correction of a variation in injection quantity of the fuel injection valve includes, for example, a technique described in Patent Literature 1, in which a drive voltage UM of a solenoid is compared to a reference voltage UR being the drive voltage UM filtered by a low-pass filter, and an armature position of the solenoid is detected based on an intersection of the two voltages.

In the technique of Patent Literature 1, however, the unfiltered drive voltage UM (raw value) is compared to the filtered reference voltage UR: hence, the intersection of the two voltages may not be accurately detected due to influence of noise superimposed on the unfiltered drive voltage UM. In addition, the intersection of the drive voltage UM and the reference voltage UR may not exist depending on characteristics of the solenoid. It is therefore difficult to accurately detect the armature position of the solenoid. Hence, the technique of Patent Literature 1 cannot accurately correct the variation in the injection quantity of the fuel injection valve due to the variation in the lift amount in the partial lift region.

PRIOR ART LITERATURES

Patent Literature

[Patent Literature 1] US-2003/0071613 A1

SUMMARY OF INVENTION

It is an object of the present disclosure to provide a fuel injection control system of an internal combustion engine, which accurately corrects the variation in injection quantity of the fuel injection valve due to the variation in lift amount in the partial lift region, leading to improvement in control accuracy of the injection quantity in the partial lift region.

According to an embodiment of the present disclosure, there is provided a fuel injection control system of an internal combustion engine having an electromagnetic driving fuel injection valve, the fuel injection control system including: an injection control means that performs full lift injection to drive the fuel injection valve to open with an injection pulse allowing a lift amount of a valve element of the fuel injection valve to reach a full lift position, and performs partial lift injection to drive the fuel injection valve to open with an injection pulse allowing the lift amount of the valve element not to reach the full lift position; a filtered-voltage acquisition means that, after off of the injection pulse of the partial lift injection, acquires a first filtered voltage being a terminal voltage of the fuel injection valve filtered by a first low-pass filter having a first frequency as a cutoff frequency, the first frequency being lower than a frequency of a noise component, and acquires a second filtered voltage being the terminal voltage filtered by a second low-pass filter having a second frequency as a cutoff frequency, the second frequency being lower than the first frequency; a difference calculation means that calculates a difference between the first filtered voltage and the second filtered voltage; a time calculation means that calculates time from a predetermined reference timing to a timing when the difference has an inflection point as voltage inflection time; and an injection pulse correction means that corrects the injection pulse of the partial lift injection based on the voltage inflection time.

The injection pulse correction means has a storage means that beforehand stores a relationship between the voltage inflection time and the injection quantity for each of a plurality of injection pulse widths each providing the partial lift injection, and calculates a required injection pulse width corresponding to a required injection quantity based on the relationship between the voltage inflection time and the injection quantity, the relationship being beforehand stored in the storage means, and based on the voltage inflection time calculated by the time calculation means.

A terminal voltage (for example, a negative terminal voltage) of the fuel injection valve is varied by induced electromotive force after off of the injection pulse (see FIG. 16). At this time, when the fuel injection valve is closed, shift speed of the valve element (shift speed of a movable core) varies relatively greatly, and thus a variation characteristic of the terminal voltage is varied. This results in such a voltage inflection point that the variation characteristic of the terminal voltage is varied near valve-closing timing.

Focusing on such a characteristic, in the disclosure, after off of the injection pulse of the partial lift injection, the first filtered voltage being the terminal voltage filtered by the first low-pass filter having the first frequency as a cutoff frequency, the first frequency being lower than a frequency of a noise component, is acquired, and the second filtered voltage being the terminal voltage filtered by the second low-pass filter having the second frequency as a cutoff frequency, the second frequency being lower than the first frequency, is acquired. Consequently, it is possible to acquire the first filtered voltage being the terminal voltage from which a noise component is removed and the second filtered voltage for voltage inflection detection.

Furthermore, the difference between the first filtered voltage and the second filtered voltage is calculated, and the time from the predetermined reference timing to the timing when the difference has an inflection point is calculated as the voltage inflection time. Consequently, it is possible to accurately calculate the voltage inflection time that varies depending on the valve-closing timing of the fuel injection valve.

In the partial lift region of the fuel injection valve, as illustrated in FIG. 6, a variation in lift amount causes variations in injection quantity and in valve-closing timing, leading to a correlation between the injection quantity of the fuel injection valve and the valve-closing timing. Furthermore, the voltage inflection time varies depending on valve-closing timing of the fuel injection valve, leading to a correlation between the voltage inflection time and the injection quantity as illustrated in FIG. 7.

Focusing on such relationships, the injection pulse of the partial lift injection is corrected based on the voltage inflection time, thereby the injection pulse of the partial lift injection can be accurately corrected.

Here, in the disclosure, the relationship between the voltage inflection time and the injection quantity is beforehand stored for each of a plurality of injection pulse widths each providing the partial lift injection. In addition, the required injection pulse width corresponding to the required injection quantity is calculated based on the relationship between the voltage inflection time and the injection quantity beforehand stored for each injection pulse width and based on the voltage inflection time calculated by the time calculation means (i.e., voltage inflection time reflecting a current injection characteristic of the fuel injection valve). This makes it possible to accurately set a required injection pulse width necessary for achieving the required injection quantity for the current injection characteristic of the fuel injection valve. Consequently, it is possible to accurately correct the variation in injection quantity due to the variation in lift amount in the partial lift region, leading to improvement in control accuracy of the injection quantity in the partial lift region.

BRIEF DESCRIPTION OF DRAWINGS

The above-described objects, other objects, features, and advantages of the present disclosure will be more clarified from the following detailed description with reference to the accompanying drawings.

EMBODIMENTS FOR CARRYING OUT INVENTION

Some embodiments embodying modes for carrying out the disclosure are now described.

First Embodiment

A first embodiment of the disclosure is described with reference to FIGS. 1 to 16.

Figure 1:
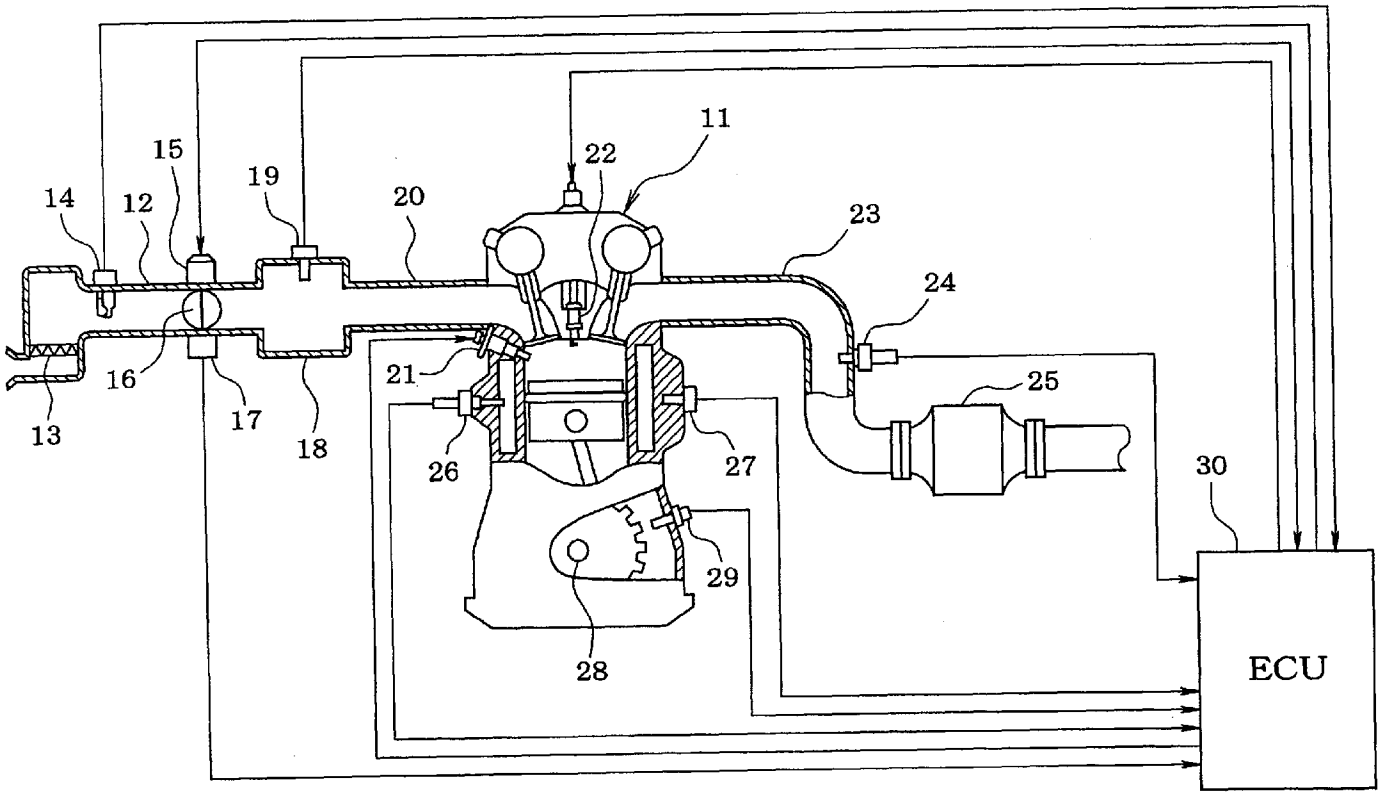
FIG. 1 is a diagram illustrating a schematic configuration of an engine control system of a first embodiment of the disclosure.

A schematic configuration of an engine control system is described with reference to FIG. 1.

An in-cylinder injection engine 11, which is an in-cylinder injection internal combustion engine, has an air cleaner 13 on a most upstream side of an intake pipe 12, and has an air flow meter 14 detecting an intake air amount on a downstream side of the air cleaner 13. A throttle valve 16, of which the degree of opening is adjusted by a motor 15, and a throttle position sensor 17, which detects the degree of opening of the throttle valve 16 (throttle position), are provided on a downstream side of the air flow meter 14.

A surge tank 18 is further provided on the downstream side of the throttle valve 16, and an intake pipe pressure sensor 19 detecting intake pipe pressure is provided in the surge tank 18. The surge tank 18 has an intake manifold 20 introducing air into each cylinder of the engine 11, and the cylinder has a fuel injection valve 21 that directly injects fuel into the cylinder. An ignition plug 22 is attached to each cylinder head of the engine 11. An air-fuel mixture in each cylinder is ignited by spark discharge of the ignition plug 22 of each cylinder.

An exhaust pipe 23 of the engine 11 has an exhaust gas sensor 24 (an air-fuel ratio sensor, an oxygen sensor) that detects an air-fuel ratio, rich or lean, etc. of exhaust gas. A catalyst 25 such as a ternary catalyst purifying the exhaust gas is provided on a downstream side of the exhaust gas sensor 24.

A cooling water temperature sensor 26 detecting cooling water temperature and a knock sensor 27 detecting knocking are attached to a cylinder block of the engine 11. A crank angle sensor 29, which outputs a pulse signal every time when a crank shaft 28 rotates a predetermined crank angle, is attached on a peripheral side of the crank shaft 28, and a crank angle or engine rotation speed is detected based on an output signal of the crank angle sensor 29.

Output of each of such sensors is received by an electronic control unit (hereinafter mentioned as "ECU") 30. The ECU 30 is mainly configured of a microcomputer, and executes various engine control programs stored in an internal ROM (storage medium), and thereby controls a fuel injection quantity, ignition timing, and a throttle position (an intake air amount) depending on an engine operation state.

Figure 2:
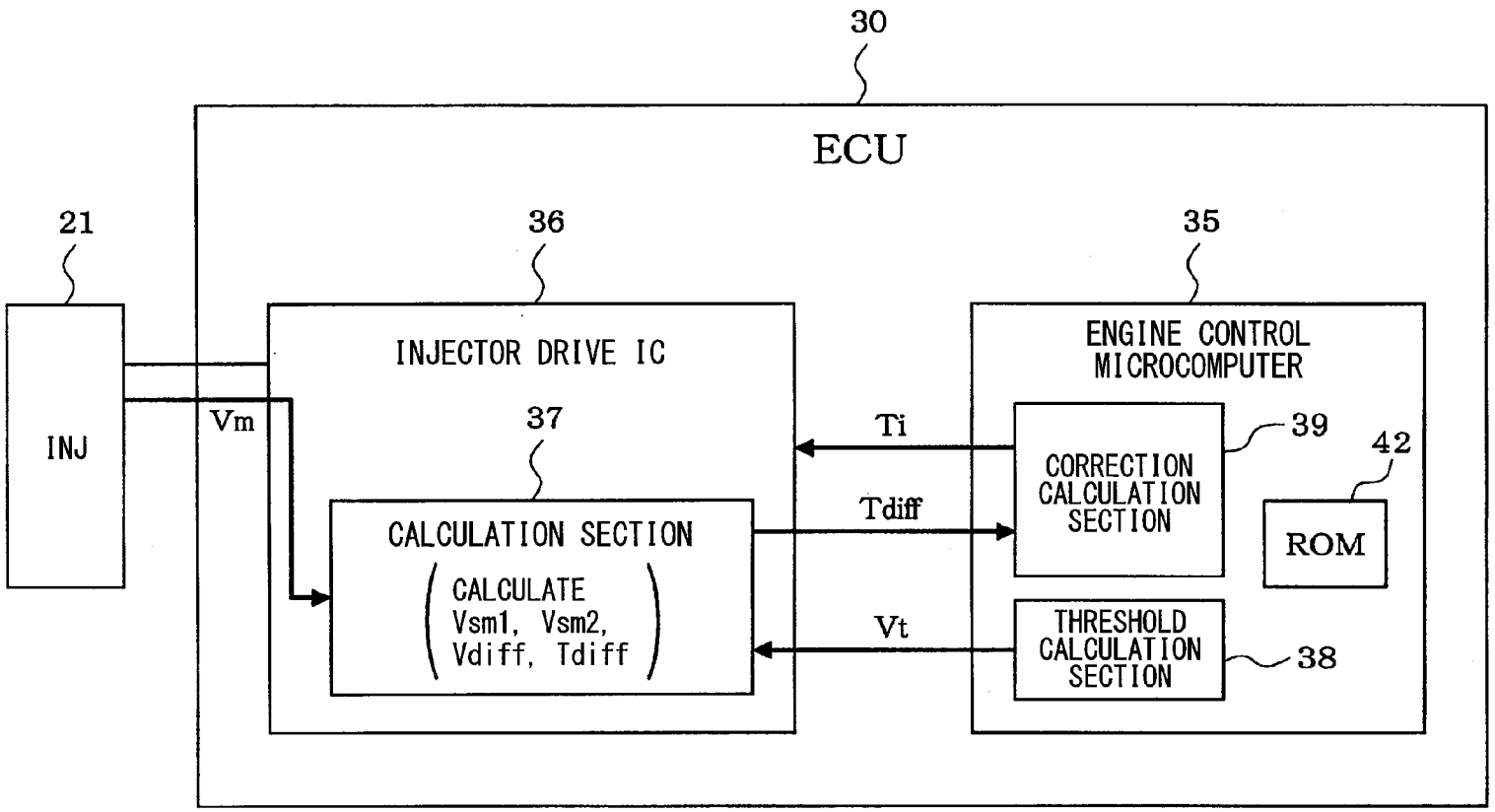
FIG. 2 is a block diagram illustrating a configuration of ECU of the first embodiment.

As illustrated in FIG. 2, the ECU 30 has an engine control microcomputer 35 (a microcomputer for control of the engine 11), and an injector drive IC 36 (a drive IC of the fuel injection valve 21), and the like. The ECU 30, specifically the engine control microcomputer 35, calculates a required injection quantity in correspondence to an operation state of the engine (for example, engine rotation speed or an engine load), and calculates a required injection pulse width Ti (injection time) in correspondence to the required injection quantity. In addition, the ECU 30, specifically the injector drive IC 36, drives the fuel injection valve 21 to open with the required injection pulse width Ti corresponding to the required injection quantity so that fuel corresponding to the required injection quantity is injected.

Figure 3:
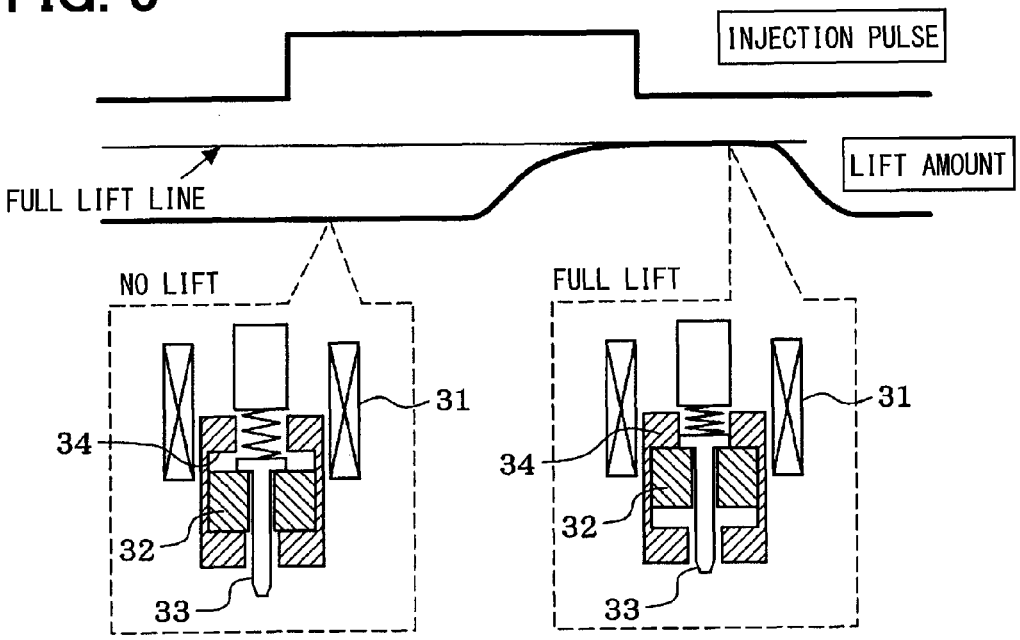
FIG. 3 is a schematic illustration of full lift of a fuel injection valve.
Figure 4:
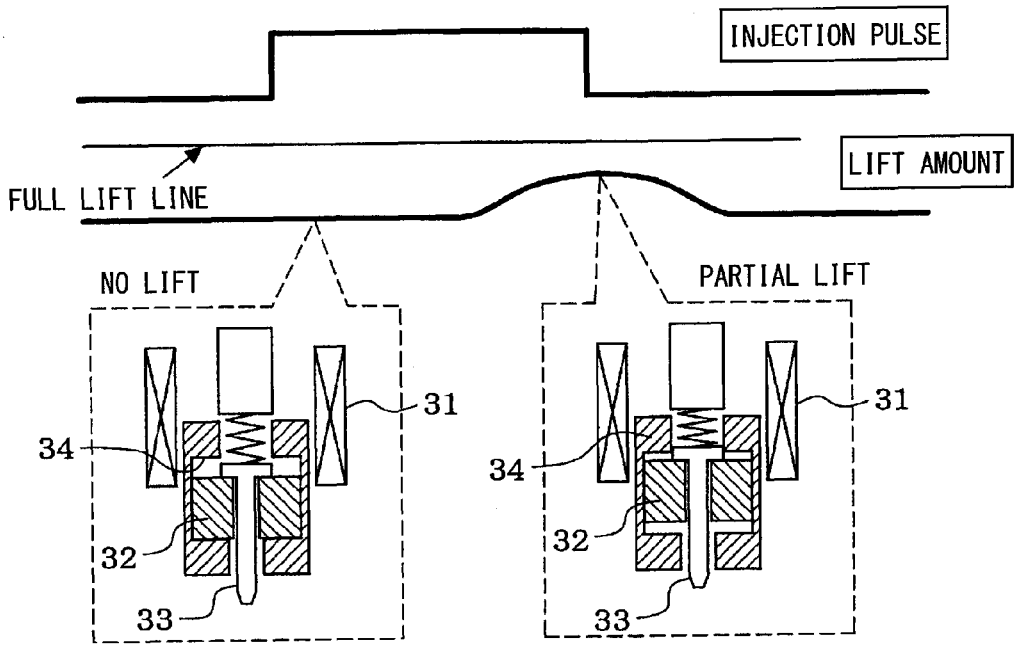
FIG. 4 is a schematic illustration of partial lift of the fuel injection valve.

As illustrated in FIGS. 3 and 4, the fuel injection valve 21 is configured such that when an injection pulse is on so that a current is applied to a drive coil 31, a needle valve 33 (valve element) is moved in a valve-opening direction together with a plunger 32 (movable core) by electromagnetic force generated by the drive coil 31. As illustrated in FIG. 3, the lift amount of the needle valve 33 reaches a full lift position (a position at which the plunger 32 butts against a stopper 34) in a full lift region where an injection pulse width is relatively long. As illustrated in FIG. 4, a partial lift state (a state just before the plunger 32 butts against the stopper 34), in which the lift amount of the needle valve 33 does not reach the full lift position, is given in a partial lift region where the injection pulse width is relatively short.

The ECU 30 serves as an injection control means that performs, in the full lift region, full lift injection to drive the fuel injection valve 21 to open with an injection pulse allowing the lift amount of the needle valve 33 to reach the full lift position, and performs, in the partial lift region, partial lift injection to drive the fuel injection valve 21 to open with an injection pulse providing the partial lift state in which the lift amount of the needle valve 33 does not reach the full lift position.

Figure 5:
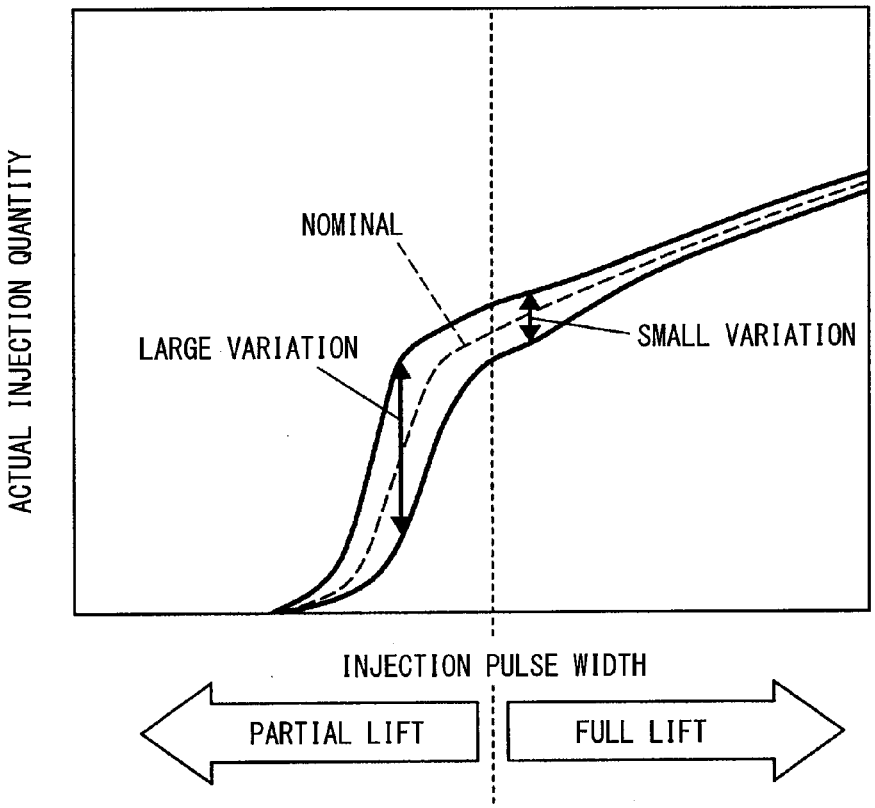
FIG. 5 is a diagram illustrating a relationship between an injection pulse width and an actual injection quantity of the fuel injection valve.

For the fuel injection valve 21 of the in-cylinder injection engine 11 that injects high-pressure fuel into the cylinder, as illustrated in FIG. 5, linearity of a variation characteristic of an actual injection quantity with respect to an injection pulse width tends to degrade in the partial lift region (a region of the partial lift state in which the injection pulse width is short so that the lift amount of the needle valve 33 does not reach the full lift position). In the partial lift region, the lift amount of the needle valve 33 tends to greatly vary, leading to a large variation in the injection quantity. Such a large variation in the injection quantity may degrade exhaust emission and drivability.

Figure 16:
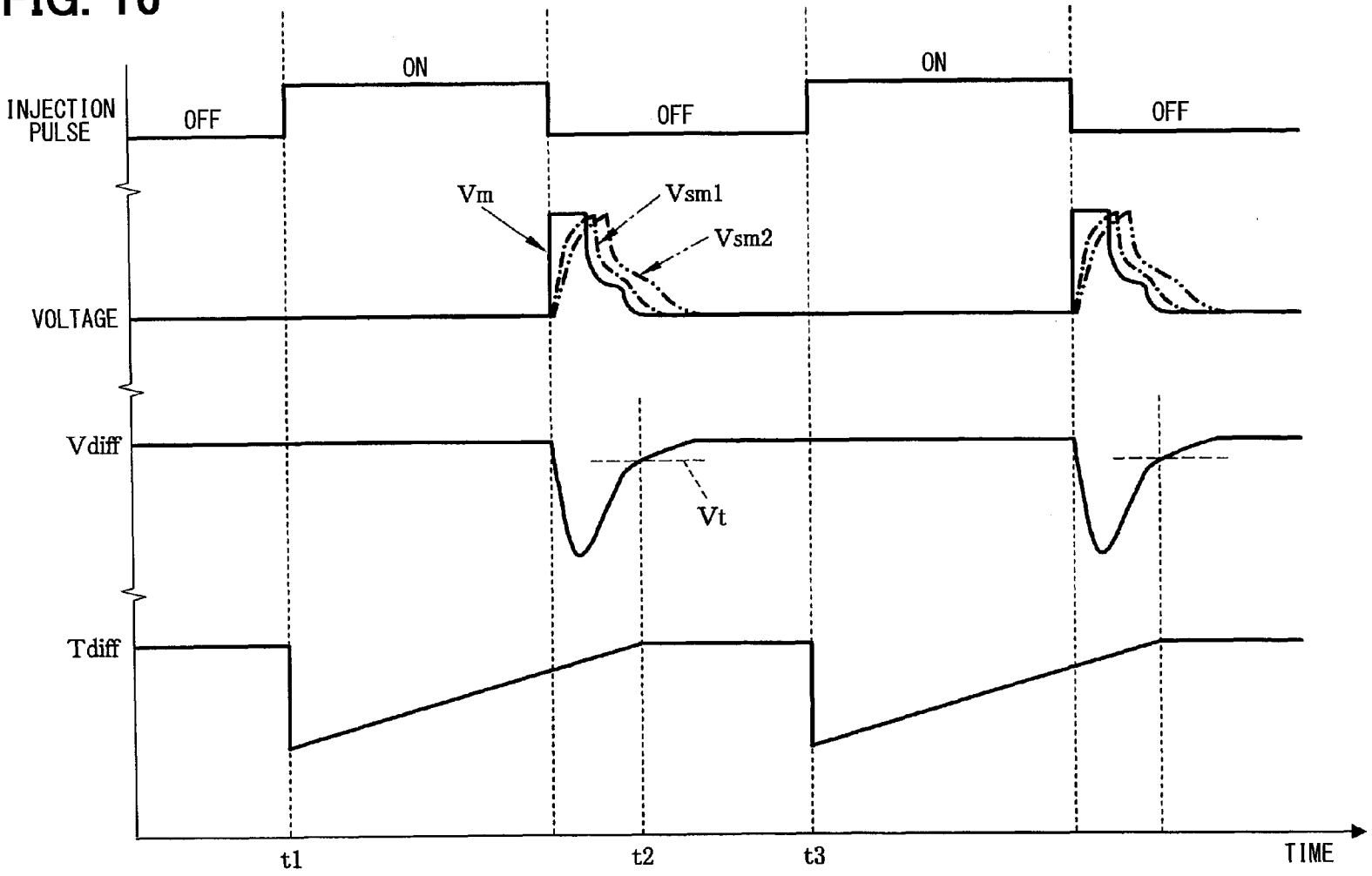
FIG. 16 is a time chart illustrating an execution example of voltage inflection time calculation in the first embodiment.

The negative terminal voltage of the fuel injection valve 21 is varied by induced electromotive force after off of the injection pulse (see FIG. 16). At this time, when the fuel injection valve 21 is closed, shift speed of the needle valve 33 (shift speed of the plunger 32) varies relatively greatly, and thus a variation characteristic of the negative terminal voltage is varied. This results in such a voltage inflection point that the variation characteristic of the negative terminal voltage is varied near the valve-closing timing.

Focusing on such a characteristic, in the first embodiment, the ECU 30 (for example, the injector drive IC 36) executes a voltage inflection time calculation routine of FIG. 12 described later, thereby the voltage inflection time as information on the valve-closing timing is calculated as follows.

During the partial lift injection (at least after off of an injection pulse of the partial lift injection), the ECU 30, specifically a calculation section 37 (see FIG. 2) of the injector drive IC 36, performs a process for each of the cylinders of the engine 11. In the process, the ECU 30 calculates a first filtered voltage Vsm1 being a negative terminal voltage Vm of the fuel injection valve 21 filtered (moderated) by a first low-pass filter having a first frequency f1 as a cutoff frequency, the first frequency f1 being lower than a frequency of a noise component, and calculates a second filtered voltage Vsm2 being the negative terminal voltage Vm of the fuel injection valve 21 filtered (moderated) by a second low-pass filter having a second frequency f2 as a cutoff frequency, the second frequency f2 being lower than the first frequency. Consequently, it is possible to calculate the first filtered voltage Vsm1 being the negative terminal voltage Vm from which a noise component is removed, and the second filtered voltage Vsm2 for voltage inflection detection.

Furthermore, the ECU 30, specifically the calculation section 37 of the injector drive IC 36, performs a process for each of the cylinders of the engine 11. In the process, the ECU 30 calculates a difference Vdiff (=Vsm1−Vsm2) between the first filtered voltage Vsm1 and the second filtered voltage Vsm2, and calculates time from a predetermined reference timing to a timing when the difference Vdiff has a inflection point as voltage inflection time Tdiff. At this time, in the first embodiment, the ECU 30 calculates the voltage inflection time Tdiff with a timing when the difference Vdiff exceeds a predetermined threshold Vt as the timing when the difference Vdiff has an inflection point. In other words, time from the predetermined reference timing to the timing when the difference Vdiff exceeds the predetermined threshold Vt is calculated as the voltage inflection time Tdiff. Consequently, it is possible to accurately calculate the voltage inflection time Tdiff that varies depending on the valve-closing timing of the fuel injection valve 21. In the first embodiment, the voltage inflection time Tdiff is calculated with the reference timing being a timing when an injection pulse of the partial lift injection is switched from off to on. The threshold Vt is calculated by a threshold calculation section 38 (see FIG. 2) of the engine control microcomputer 35 depending on fuel pressure, fuel temperature, or the like. The threshold Vt may be a beforehand set, fixed value.

Figure 6:
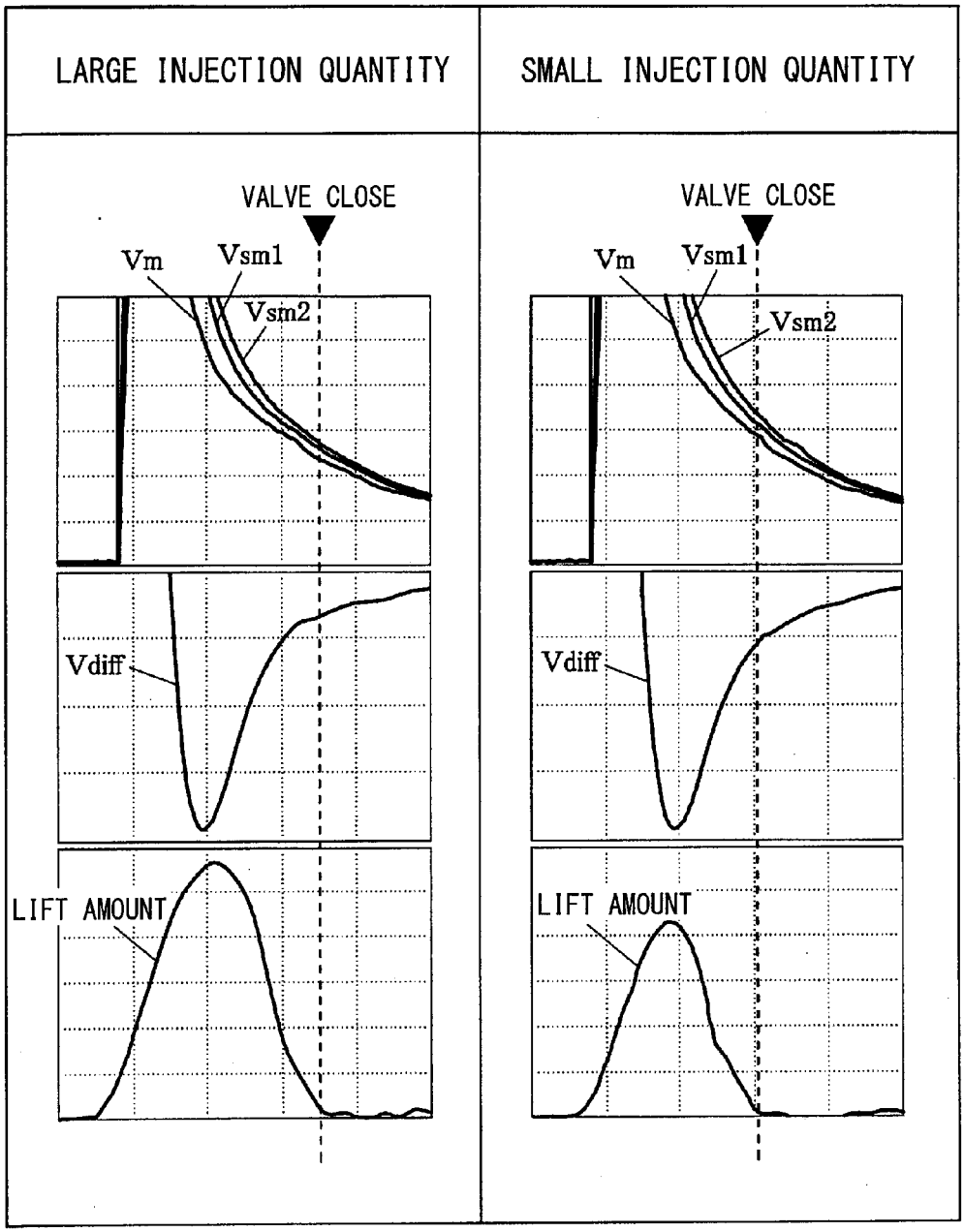
FIG. 6 is a schematic illustration of a relationship between an injection quantity and valve-closing timing of the fuel injection valve.
Figure 7:
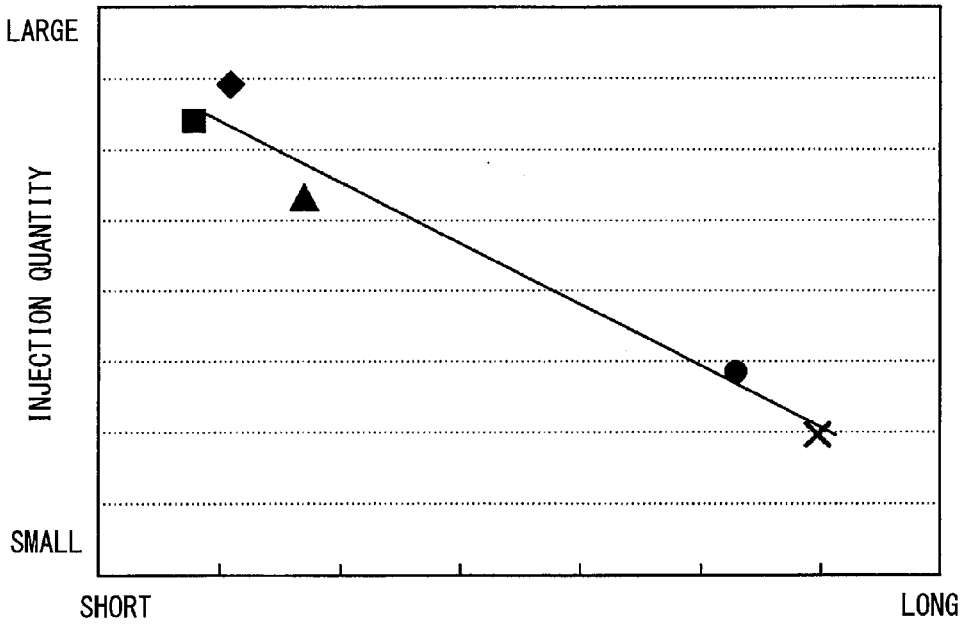
FIG. 7 is a diagram illustrating a relationship between voltage inflection time and the injection quantity of the fuel injection valve.

In the partial lift region of the fuel injection valve 21, as illustrated in FIG. 6, since a variation in lift amount of the fuel injection valve 21 causes variations in the injection quantity and in the valve-closing timing, a correlation exists between the injection quantity and the valve-closing timing of the fuel injection valve 21. Furthermore, since the voltage inflection time Tdiff varies depending on the valve-closing timing of the fuel injection valve 21, a correlation exists between the voltage inflection time Tdiff and the injection quantity as illustrated in FIG. 7.

Focusing on such relationships, in the first embodiment, the ECU 30 (for example, the engine control microcomputer 35) executes an injection pulse correction routine of FIGS. 13 and 14 described later. The ECU 30 thereby corrects the injection pulse of the partial lift injection based on the voltage inflection time Tdiff as follows.

Figure 8:
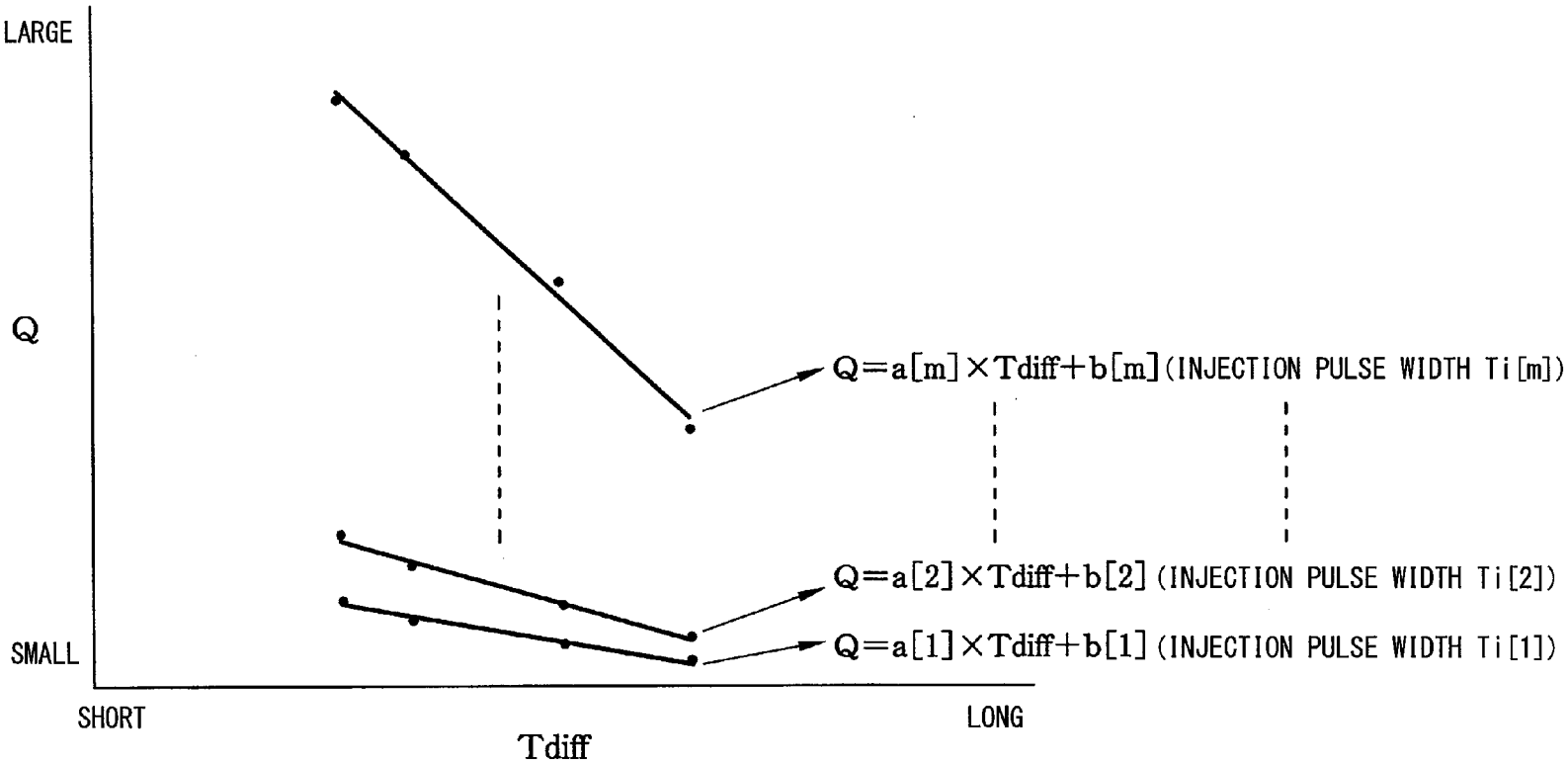
FIG. 8 is a schematic illustration of a primary expression approximating a relationship between voltage inflection time Vdiff and an injection quantity Q.

The ECU 30 beforehand stores, in the ROM 42 (storage means) of the engine control microcomputer 35, the relationship between the voltage inflection time Tdiff and the injection quantity Q for each of a plurality of injection pulse widths Ti each providing the partial lift injection. In the first embodiment, a primary expression "Q=a×Tdiff+b", which approximates the relationship between the voltage inflection time Tdiff and the injection quantity Q, is used as a representation of the relationship between the voltage inflection time Tdiff and the injection quantity Q. In this case, as illustrated in FIG. 8, the primary expression "Q=a×Tdiff+b", which approximates the relationship between the voltage inflection time Tdiff and the injection quantity Q, is beforehand produced for each of a plurality of (for example, m) injection pulse widths Ti[1] to Ti[m] based on test data or the like, and the slope a and the intercept b of the primary expression "Q=a×Tdiff+b" are beforehand stored in the ROM 42 for each of the injection pulse widths Ti.

Figure 9:
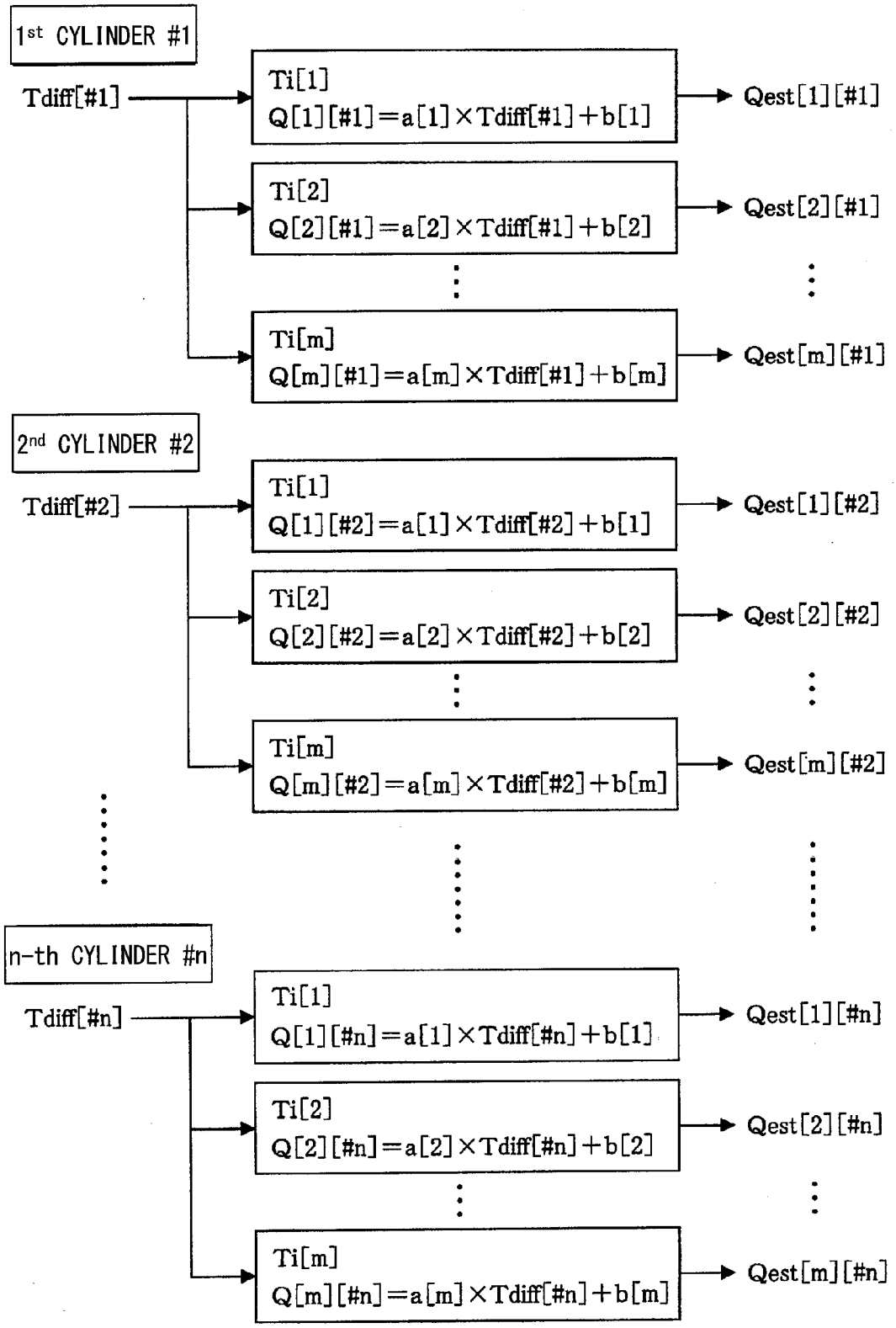
FIG. 9 is a schematic illustration of a process of estimating an injection quantity Qest corresponding to the voltage inflection time Vdiff.

The ECU 30, specifically an injection pulse correction calculation section 39 of the engine control microcomputer 35, performs a process for each of the cylinders of the engine 11. In the process, the ECU 30 uses the relationship between the voltage inflection time Tdiff and the injection quantity Q (primary expression "Q=a×Tdiff+b") beforehand stored in the ROM 42 for each of the injection pulse widths Ti to estimate the injection quantity Qest corresponding to the voltage inflection time Tdiff calculated by the injector drive IC 36 (calculation section 37) for each of the injection pulse widths Ti. Specifically, as illustrated in FIG. 9, in the case of the n-cylinder engine 11, for each of a first cylinder #1 to a nth cylinder #n, the ECU 30 uses the primary expression "Q=a×Tdiff+b", which is stored for each of the injection pulse widths Ti[1] to Ti[m], to estimate (calculate) the injection quantity Qest corresponding to the voltage inflection time Tdiff of a corresponding cylinder for each of the injection pulse widths Ti. Consequently, the ECU 30 can estimate the injection quantity Qest corresponding to the current voltage inflection time Tdiff (i.e., the voltage inflection time Tdiff reflecting the current injection characteristic of the fuel injection valve 21) for each of the injection pulse widths Ti.

Figure 10:
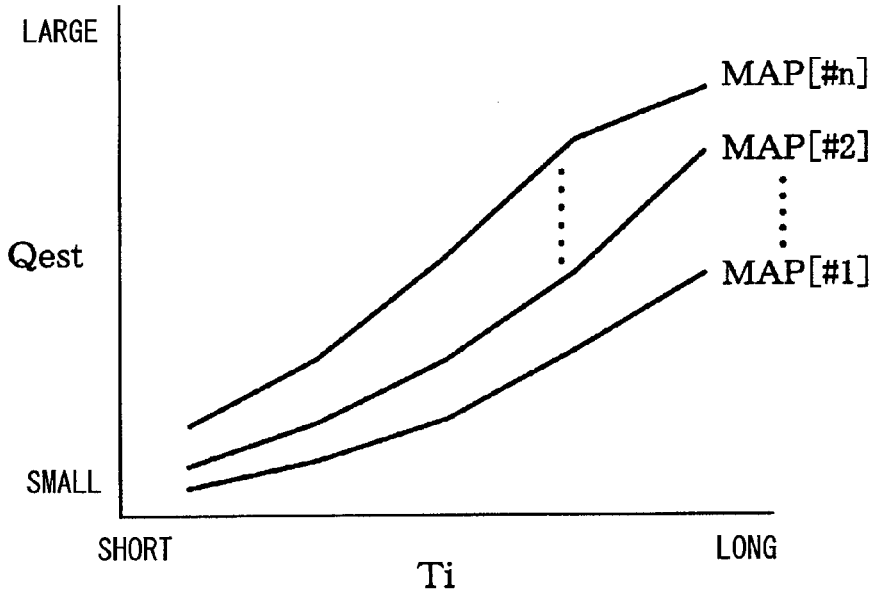
FIG. 10 is a diagram conceptionally illustrating an exemplary map defining a relationship between an injection pulse width Ti and the injection quantity Qest.

Furthermore, the ECU 30 performs a process for each of the cylinders of the engine 11, in which the relationship between the injection pulse width Ti and the injection quantity Qest is set based on a result of such estimation (a result of estimating the injection quantity Qest corresponding to the voltage inflection time Tdiff for each of the injection pulse widths Ti). Specifically, as illustrated in FIG. 10, for the n-cylinder engine 11, a map is created for each of the first cylinder #1 to the nth cylinder #n, the map defining the relationship between the injection pulse width Ti and the injection quantity Qest. This makes it possible to set a relationship between the injection pulse width Ti and the injection quantity Qest in correspondence to the current injection characteristic of the fuel injection valve 21, and correct the relationship between the injection pulse width Ti and the injection quantity Qest.

Figure 11:
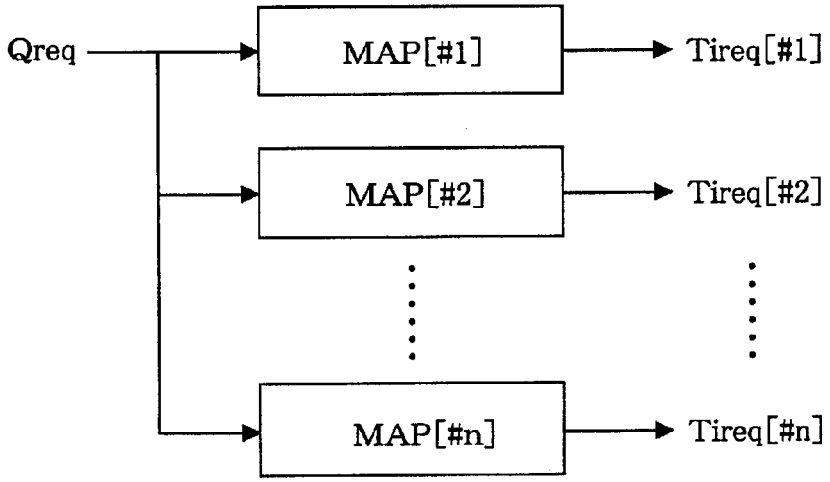
FIG. 11 is a schematic illustration of a process of calculating a required injection pulse width Tireq corresponding to a required injection quantity Qreq.

Subsequently, the ECU 30 performs a process for each of the cylinders of the engine 11, in which a required injection pulse width Tireq corresponding to the required injection quantity Qreq is calculated using the map defining the relationship between the injection pulse width Ti and the injection quantity Qest. Specifically, as illustrated in FIG. 11, in the case of the n-cylinder engine 11, for each of the first cylinder #1 to the nth cylinder #n, the ECU 30 uses a map (a map defining the relationship between the injection pulse width Ti and the injection quantity Qest) for the corresponding cylinder to calculate the required injection pulse width Tireq corresponding to the required injection quantity Qreq. This makes it possible to accurately set the required injection pulse width Tireq necessary for achieving the required injection quantity Qreq for the current injection characteristic of the fuel injection valve 21.

In the first embodiment, the injector drive IC 36 (the calculation section 37) collectively serves as the filtered-voltage acquisition means, the difference calculation means, and the time calculation means, and the engine control microcomputer 35 (an injection pulse correction calculation section 39) serves as the injection pulse correction means.

Figure 12:
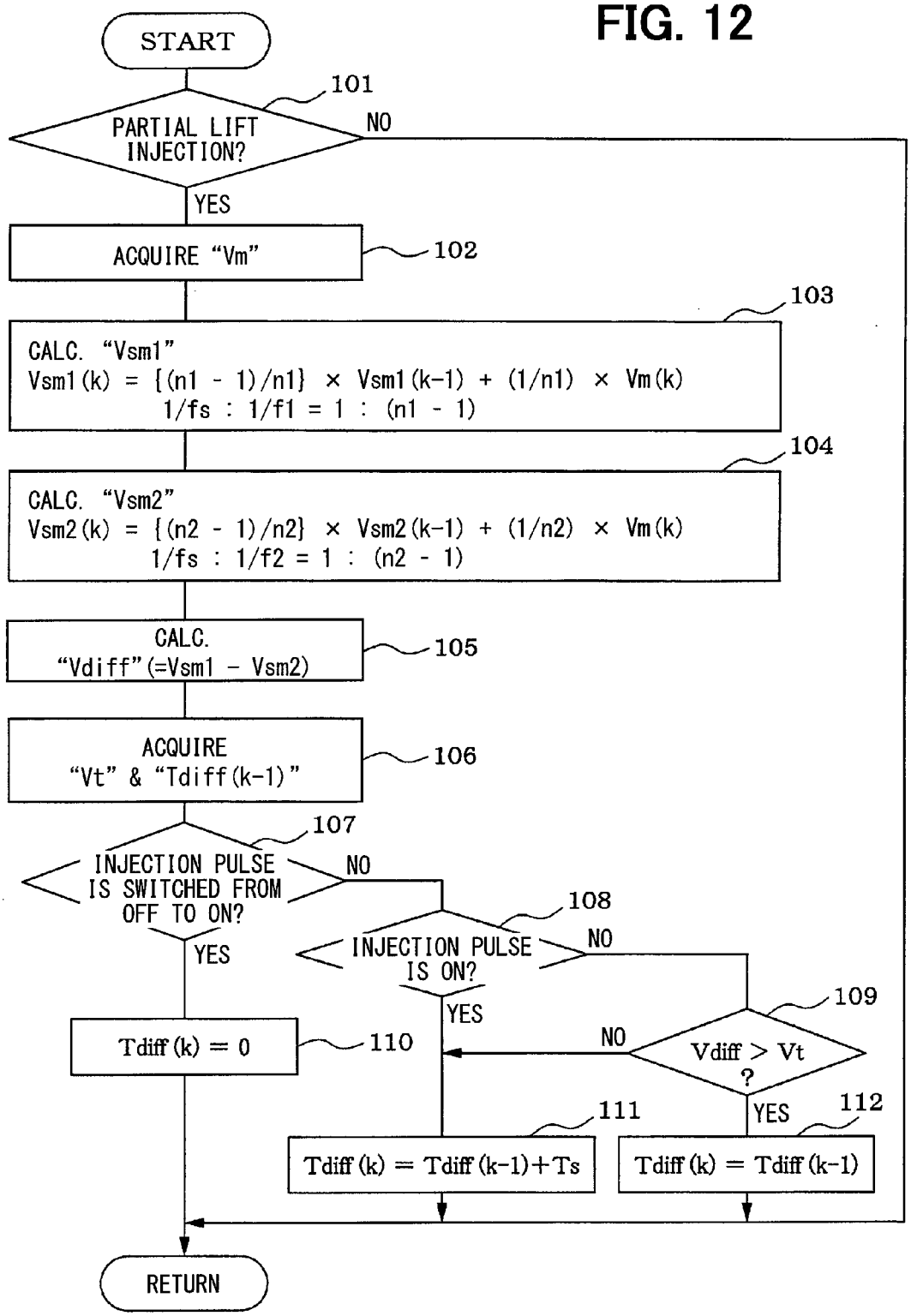
FIG. 12 is a flowchart illustrating a procedure of a voltage inflection time calculation routine in the first embodiment.
Figure 13:
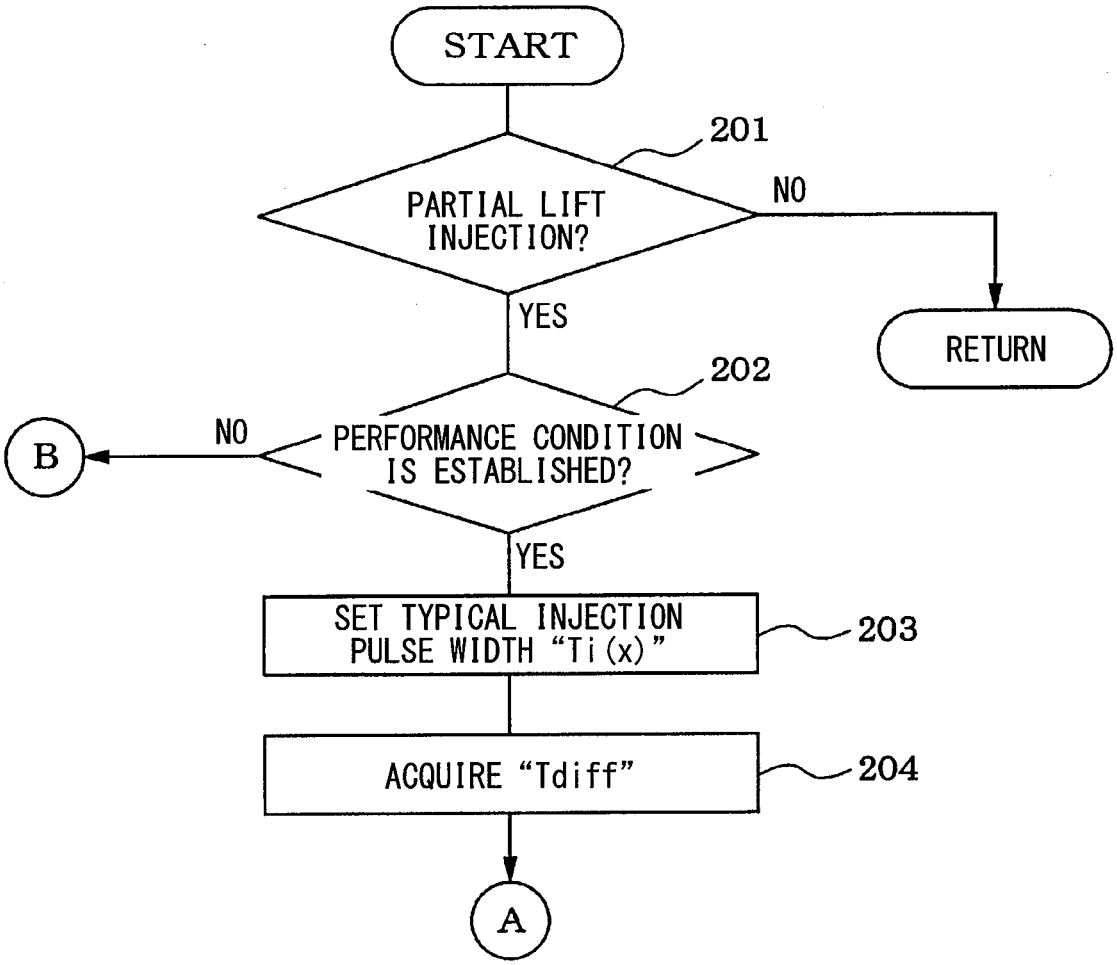
FIG. 13 is a flowchart illustrating a procedure of an injection pulse correction routine in the first embodiment.
Figure 14:
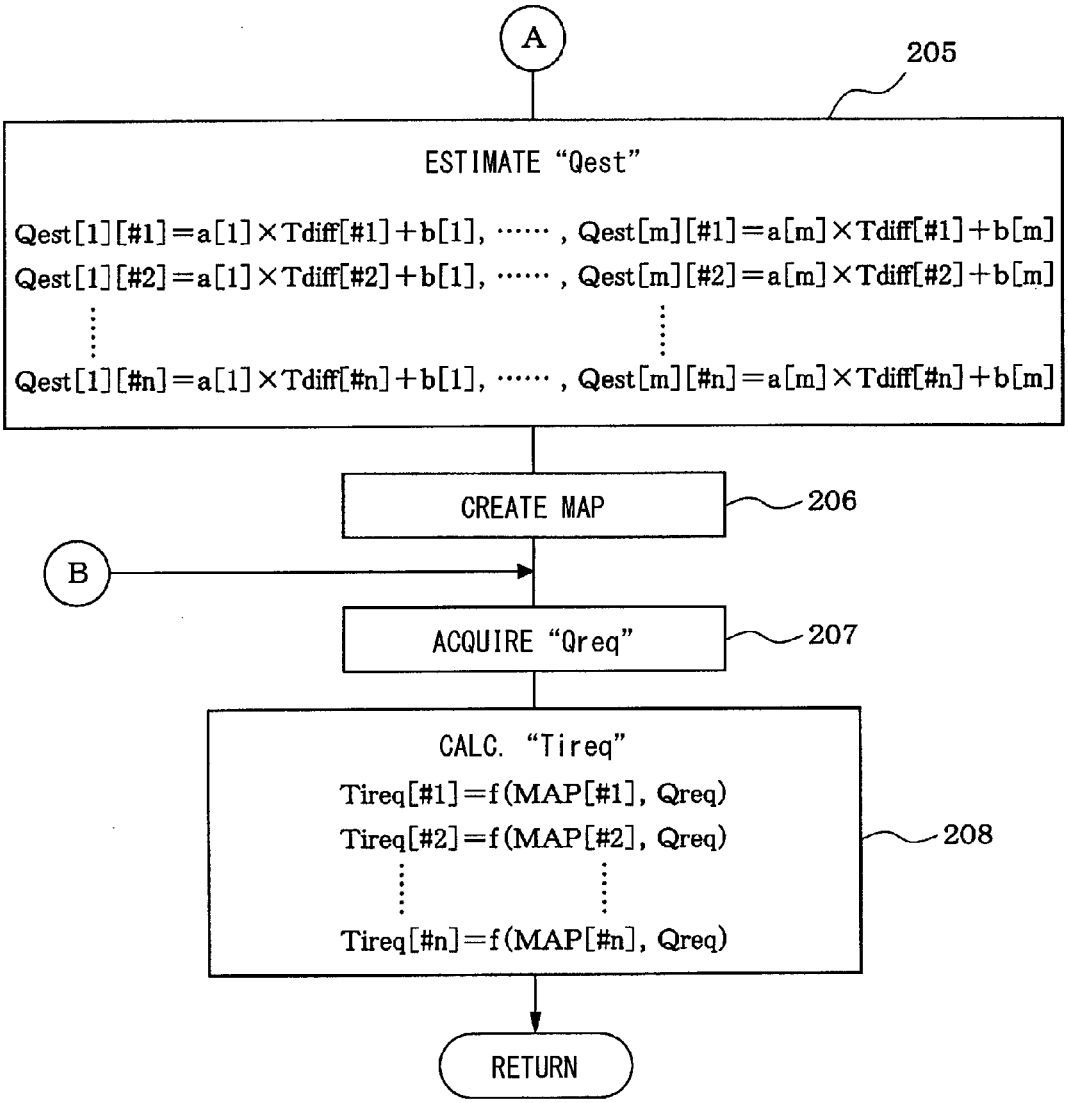
FIG. 14 is a flowchart illustrating a procedure of the injection pulse correction routine in the first embodiment.

Processing details of routines, i.e., the voltage inflection time calculation routine of FIG. 12 and the injection pulse correction routine of FIGS. 13 and 14, executed by the ECU 30 (the engine control microcomputer 35 and/or the injector drive IC 36) in the first embodiment are now described.

[Voltage Inflection Time Calculation Routine]

The voltage inflection time calculation routine illustrated in FIG. 12 is repeatedly executed with a predetermined calculation period Ts during power-on of the ECU 30 (for example, during on of an ignition switch). When this routine is started, whether or not the partial lift injection is being performed is determined in step 101. If the partial lift injection is determined to be not being performed in step 101, the routine is finished while step 102 and subsequent steps are not performed.

If the partial lift injection is determined to be being performed in step 101, then in step 102 the negative terminal voltage Vm of the fuel injection valve 21 is acquired. In this case, the calculation period Ts of the routine corresponds to a sampling period Ts of the negative terminal voltage Vm.

Subsequently, in step 103, there is calculated a first filtered voltage Vsm1 being the negative terminal voltage Vm of the fuel injection valve 21 filtered by a first low-pass filter having a first frequency f1 as a cutoff frequency, the first frequency f1 being lower than a frequency of a noise component, (i.e., a low-pass filter having a passband being a frequency band lower than the cutoff frequency f1).

The first low-pass filter is a digital filter implemented by Formula (1) to obtain a current value Vsm1(k) of the first filtered voltage using a previous value Vsm1(k−1) of the first filtered voltage and a current value Vm(k) of the negative terminal voltage.

$$Vsm1(k)=\{(n1-1)/n1\}\times Vsm1(k-1)+(1/n1)\times Vm(k) \quad (1)$$

The time constant n1 of the first low-pass filter is set such that the relationship of Formula (2) is satisfied, where fs (=1/Ts) is a sampling frequency of the negative terminal voltage Vm, and f1 is the cutoff frequency of the first low-pass filter.

$$1/fs:1/f1=1:(n1-1) \quad (2)$$

Consequently, it is possible to easily calculate the first filtered voltage Vsm1 filtered by the first low-pass filter having the first frequency f1 as the cutoff frequency, the first frequency f1 being lower than the frequency of the noise component.

Subsequently, in step 104, there is calculated a second filtered voltage Vsm2 being the negative terminal voltage Vm of the fuel injection valve 21 filtered by a second low-pass filter having a second frequency f2 as a cutoff frequency, the second frequency f2 being lower than the first frequency f1 (i.e., a low-pass filter having a passband being a frequency band lower than the cutoff frequency f2).

The second low-pass filter is a digital filter implemented by Formula (3) to obtain a current value Vsm2(k) of the second filtered voltage using a previous value Vsm2(k−1) of the second filtered voltage and a current value Vm(k) of the negative terminal voltage.

$$Vsm2(k)=\{(n2-1)/n2\}\times Vsm2(k-1)+(1/n2)\times Vm(k) \quad (3)$$

The time constant n2 of the second low-pass filter is set such that the relationship of Formula (4) is satisfied, where fs (=1/Ts) is the sampling frequency of the negative terminal voltage Vm, and f2 is the cutoff frequency of the second low-pass filter.

$$1/fs:1/f2=1:(n2-1) \quad (4)$$

Consequently, it is possible to easily calculate the second filtered voltage Vsm2 filtered by the second low-pass filter having the second frequency f2 as the cutoff frequency, the second frequency f2 being lower than the first frequency f1.

Subsequently, in step 105, the difference Vdiff (=Vsm1−Vsm2) between the first filtered voltage Vsm1 and the second filtered voltage Vsm2 is calculated. The difference Vdiff may be subjected to guard processing so as to be less than 0 to extract only a negative component.

Subsequently, in step 106, the threshold Vt is acquired, and a previous value Tdiff(k−1) of the voltage inflection time is acquired.

Subsequently, in step 107, whether or not the injection pulse is switched from off to on at the current timing is determined. If the injection pulse is determined to be switched from off to on at the current timing in step 107, then in step 110 a current value Tdiff(k) of the voltage inflection time is reset to "0".

$$Tdiff(k)=0$$

If the injection pulse is determined to be not switched from off to on at the current timing in step 107, then in step 108 whether or not the injection pulse is on is determined. If the injection pulse is determined to be on in step 108, then in step 111 a predetermined value Ts (the calculation period of this routine) is added to the previous value Tdiff(k−1) of the voltage inflection time to obtain the current value Tdiff(k) of the voltage inflection time, so that the voltage inflection time Tdiff is counted up.

$$Tdiff(k)=Tdiff(k-1)+Ts$$

If the injection pulse is determined to be not on (i.e., the injection pulse is off) in step 108, then in step 109 whether or not the difference Vdiff between the first filtered voltage Vsm1 and the second filtered voltage Vsm2 exceeds the threshold Vt (whether or not the difference Vdiff inversely becomes larger than the threshold Vt) is determined.

If the difference Vdiff between the first filtered voltage Vsm1 and the second filtered voltage Vsm2 is determined not to exceed the threshold Vt in step 109, the voltage inflection time Tdiff is continuously counted up in step 111.

If the difference Vdiff between the first filtered voltage Vsm1 and the second filtered voltage Vsm2 is determined to exceed the threshold Vt in step 109, then in step 112 calculation of the voltage inflection time Tdiff is determined to be completed, and the current value Tdiff(k) of the voltage inflection time is maintained to the previous value Tdiff(k−1).

$$Tdiff(k)=Tdiff(k-1)$$

Consequently, time from a timing (reference timing), at which the injection pulse is switched from off to on, to a timing, at which the difference Vdiff exceeds the threshold Vt, is calculated as the voltage inflection time Tdiff, and the calculated value of the voltage inflection time Tdiff is maintained until the next reference timing. The process of calculating the voltage inflection time Tdiff is thus performed for each of the cylinders of the engine 11.

[Injection Pulse Correction Routine]

The injection pulse correction routine illustrated in FIGS. 13 and 14 is repeatedly executed with a predetermined calculation period during power-on of the ECU 30 (for example, during on of the ignition switch). When this routine is started, whether or not the partial lift injection is being performed is determined in step 201. If the partial lift injection is determined to be not being performed in step 201, the routine is finished while step 202 and subsequent steps are not executed.

If the partial lift injection is determined to be being performed in step 201, then in step 202 whether or not a predetermined performance condition is established is determined based on, for example, whether or not the injection pulse width Ti may be set to a typical injection pulse width Ti(x) described later in the current operation state.

If the predetermined performance condition is determined to be established in step 202, then in step 203 the injection pulse width Ti is set to one typical injection pulse width Ti(x) among the injection pulse widths each providing the partial lift injection.

Figure 15:
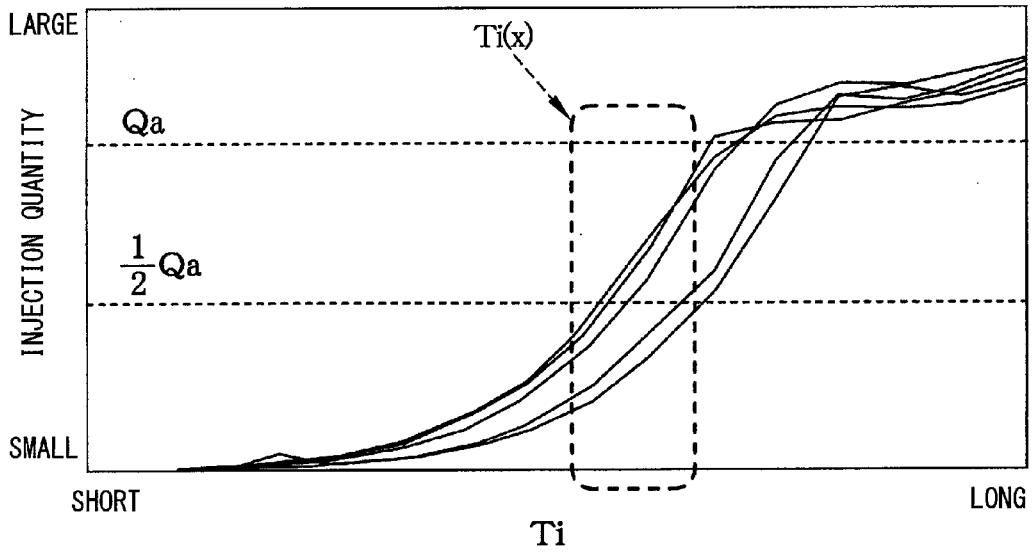
FIG. 15 is a schematic illustration of a typical injection pulse width Ti(x).

As illustrated in FIG. 15, for the fuel injection valve 21, a variation range of the injection quantity tends to be maximal in a region near an injection pulse width (an injection pulse width within a region shown by a dotted line in FIG. 15) giving an injection quantity roughly half the injection quantity Qa corresponding to the boundary of the partial lift injection and the full lift injection. In consideration of such a characteristic, the typical injection pulse width Ti(x) is set to an injection pulse width giving an injection quantity that is half the injection quantity Qa corresponding to the boundary of the partial lift injection and the full lift injection.

Subsequently, in step 204, there is acquired the voltage inflection time Tdiff for each of the cylinders (the first cylinder #1 to the nth cylinder #n) calculated through the routine of FIG. 12. In other words, when the partial lift injection is performed with the typical injection pulse width Ti(x), the voltage inflection time Tdiff for each cylinder calculated by the injector drive IC 36 (calculation section 37) is acquired.

Subsequently, in step 205 of FIG. 14, for each of the cylinders (the first cylinder #1 to the nth cylinder #n), the primary expression "Q=a×Tdiff+b" stored for each of the injection pulse widths Ti[1] to Ti[m] is used to estimate (calculate) the injection quantity Qest corresponding to the voltage inflection time Tdiff for a corresponding cylinder (see FIG. 9).

Subsequently, in step 206, a map (see FIG. 10) defining a relationship between the injection pulse width Ti and the injection quantity Qest for each of the cylinders (the first cylinder #1 to the nth cylinder #n) is created based on the estimation result of step 205 to revise (renew) the map defining the relationship between the injection pulse width Ti and the injection quantity Qest.

Subsequently, in step 207, the required injection quantity Qreq is acquired, and then in step 208, for each of the cylinders (the first cylinder #1 to the nth cylinder #n), the required injection pulse width Tireq corresponding to the required injection quantity Qreq is calculated using the map for the corresponding cylinder (the map defining the relationship between the injection pulse width Ti and the injection quantity Qest) (see FIG. 11).

If the predetermined performance condition is determined to be not established in step 202, then steps 203 to 206 are skipped, and in step 207 the required injection pulse width Tireq corresponding to the required injection quantity Qreq is calculated using the revised (renewed) map (steps 207 and 208).

An execution example of calculation of the voltage inflection time in the first embodiment is now described with reference to a time chart of FIG. 16.

During the partial lift injection (at least after off of the injection pulse of the partial lift injection), the first filtered voltage Vsm1 being the negative terminal voltage Vm of the fuel injection valve 21 filtered by the first low-pass filter is calculated, and the second filtered voltage Vsm2 being the negative terminal voltage Vm of the fuel injection valve 21 filtered by the second low-pass filter is calculated. Furthermore, the difference Vdiff (=Vsm1−Vsm2) between the first filtered voltage Vsm1 and the second filtered voltage Vsm2 is calculated.

The voltage inflection time Tdiff is reset to "0" at a timing (reference timing) t1 when the injection pulse is switched from off to on, and then calculation of the voltage inflection time Tdiff is started, and the voltage inflection time Tdiff is repeatedly counted up with the predetermined calculation period Ts.

Subsequently, the calculation of the voltage inflection time Tdiff is completed at a timing t2 when the difference Vdiff between the first filtered voltage Vsm1 and the second filtered voltage Vsm2 exceeds the threshold Vt after off of the injection pulse. Consequently, time from the timing (reference timing) t1, at which the injection pulse is switched from off to on, to the timing t2, at which the difference Vdiff exceeds the threshold Vt, is calculated as the voltage inflection time Tdiff.

The calculated value of the voltage inflection time Tdiff is maintained until the next reference timing t3, during which (during a period from the calculation completion timing t2 of the voltage inflection time Tdiff to the next reference timing t3) the engine control microcomputer 35 acquires the voltage inflection time Tdiff from the injector drive IC 36.

In the first embodiment, during the partial lift injection (at least after off of the injection pulse of the partial lift injection), the first filtered voltage Vsm1 being the negative terminal voltage Vm of the fuel injection valve 21 filtered by the first low-pass filter is calculated, making it possible to calculate the first filtered voltage Vsm1 containing no noise component. In addition, the second filtered voltage Vsm2 being the negative terminal voltage Vm of the fuel injection valve 21 filtered with the second low-pass filter is calculated, making it possible to calculate the second filtered voltage Vsm2 for voltage inflection detection.

Furthermore, the difference Vdiff between the first filtered voltage Vsm1 and the second filtered voltage Vsm2 is calculated, and the time from the timing (reference timing), at which the injection pulse is switched from off to on, to the timing, at which the difference Vdiff exceeds the threshold Vt, is calculated as the voltage inflection time Tdiff, making it possible to accurately calculate the voltage inflection time Tdiff that varies depending on the valve-closing timing of the fuel injection valve 21.

The injection pulse of the partial lift injection is corrected based on the voltage inflection time Tdiff, thereby the injection pulse of the partial lift injection can be accurately corrected.

At this time, in the first embodiment, the relationship between the voltage inflection time Tdiff and the injection quantity Q (primary expression "Q=a×Tdiff+b") for each of the injection pulse widths Ti, the relationship being beforehand stored in the ROM 42, is used to estimate the injection quantity Qest corresponding to the current voltage inflection time Tdiff for each of the injection pulse widths Ti, and the map defining the relationship between the injection pulse width Ti and the injection quantity Qest is created based on the estimated result. The required injection pulse width Tireq corresponding to the required injection quantity Qreq is calculated using the map, thereby the required injection pulse width Tireq necessary for achieving the required injection quantity Qreq for the current injection characteristic of the fuel injection valve 21 can be accurately set. Consequently, it is possible to accurately correct a variation in injection quantity due to a variation in lift amount in the partial lift region, leading to improvement in control accuracy of the injection quantity in the partial lift region.

In the first embodiment, the primary expression "Q=a×Tdiff+b", which approximates the relationship between the voltage inflection time Tdiff and the injection quantity Q, is used as a representation of the relationship between the voltage inflection time Tdiff and the injection quantity Q; hence, the relationship between the voltage inflection time Tdiff and the injection quantity Q can be expressed by a relatively simple numerical expression. Thus, when the injection quantity Qest corresponding to the current voltage inflection time Tdiff is estimated (calculated) using the relationship (the primary expression) between the voltage inflection time Tdiff and the injection quantity Q, a calculation load of the engine control microcomputer 35 can be reduced.

Furthermore, in the first embodiment, the slope "a" and the intercept "b" of the primary expression "Q=a×Tdiff+b" are stored in the ROM 42 for each of the injection pulse widths Ti; hence, it is possible to reduce storage data volume (memory usage) necessary for storing the relationship between the voltage inflection time Tdiff and the injection quantity Q (primary expression).

In the first embodiment, the injection pulse is corrected for each cylinder; hence, even if a variation range of the injection quantity of the fuel injection valve 21 in the partial lift region is different between the cylinders, the injection pulse is corrected for the individual cylinder (for the fuel injection valve 21 of each cylinder), and thus control accuracy of the injection quantity in the partial lift region can be improved for each cylinder.

In the first embodiment, the voltage inflection time Tdiff is calculated when the partial lift injection is performed with one typical injection pulse width Ti(x) among the pulse widths each providing the partial lift injection, and such a calculated voltage inflection time Tdiff is used for correction of the injection pulse. Hence, only the voltage inflection time Tdiff for partial lift injection with one typical injection pulse width Ti(x) is sufficiently used for correction of the injection pulse, and consequently a calculation load of the engine control microcomputer 35 can be reduced.

The first embodiment takes into consideration that the variation range of the injection quantity tends to be maximal in a region near the injection pulse width giving the injection quantity roughly half the injection quantity Qa corresponding to the boundary of the partial lift injection and the full lift injection. The typical injection pulse width Ti(x) is therefore set to the injection pulse width giving the injection quantity half the injection quantity Qa corresponding to the boundary of the partial lift injection and the full lift injection. Hence, the injection pulse can be corrected using the voltage inflection time Tdiff for the partial lift injection with the inflection pulse width giving the maximal variation range of the injection quantity (i.e., the voltage inflection time Tdiff accurately reflecting influence of the variation in the injection quantity), and consequently correction accuracy of the variation in the injection quantity can be improved.

In the first embodiment, since a digital filter is used as each of the first and second low-pass filters, the first and second low-pass filters can be easily implemented.

Furthermore, in the first embodiment, the injector drive IC 36 (the calculation section 37) collectively serves as the filtered-voltage acquisition means, the difference calculation means, and the time calculation means. Hence, the functions of the filtered-voltage acquisition means, the difference calculation means, and the time calculation means can be achieved only by modifying the specification of the injector drive IC 36 in the ECU 30, and the calculation load of the engine control microcomputer 35 can be reduced.

In the first embodiment, the voltage inflection time Tdiff is calculated with the reference timing being a timing when the injection pulse is switched from off to on; hence, the voltage inflection time Tdiff can be accurately calculated with reference to the timing when the injection pulse is switched from off to on.

In the first embodiment, the voltage inflection time Tdiff is reset at the reference timing, and then calculation of the voltage inflection time Tdiff is started, and calculation of the voltage inflection time Tdiff is completed at the timing when the difference Vdiff between the first filtered voltage Vsm1 and the second filtered voltage Vsm2 exceeds the threshold Vt. Hence, the calculated value of the voltage inflection time Tdiff can be maintained from completion of calculation of the voltage inflection time Tdiff to the next reference timing, which lengthens a period during which the engine control microcomputer 35 can acquire the voltage inflection time Tdiff.

Second Embodiment

A second embodiment of the disclosure is now described with reference to FIGS. 17 and 18. However, portions substantially the same as those in the first embodiment are not or briefly described, and differences from the first embodiment are mainly described.

In the first embodiment, the voltage inflection time Tdiff is calculated with the timing, at which the difference Vdiff between the first filtered voltage Vsm1 and the second filtered voltage Vsm2 exceeds the threshold Vt, as the timing when the difference Vdiff has an inflection point. In the second embodiment, the ECU 30 executes a voltage inflection time calculation routine of FIG. 17 described later so that the voltage inflection time Tdiff is calculated as follows.

The ECU 30, specifically the calculation section 37 of the injector drive IC 36, calculates a third filtered voltage Vdiff.sm3 being the difference Vdiff filtered (moderated) by a third low-pass filter having a third frequency f3 as the cutoff frequency, the third frequency f3 being lower than a frequency of a noise component, and calculates a fourth filtered voltage Vdiff.sm4 being the difference Vdiff filtered (moderated) by a fourth low-pass filter having a fourth frequency f4 as the cutoff frequency, the fourth frequency f4 being lower than the third frequency f3. Furthermore, a difference between the third filtered voltage Vdiff.sm3 and the fourth filtered voltage Vdiff.sm4 is calculated as a second order differential Vdiff2 (=Vdiff.sm3−Vdiff.sm4), and the voltage inflection time Tdiff is calculated with a timing when the second order differential Vdiff2 has an extreme value (for example, a timing when the second order differential Vdiff2 no longer increases) as the timing when the difference Vdiff has an inflection point. Specifically, time from a predetermined reference timing to the timing when the second order differential Vdiff2 has an extreme value is calculated as the voltage inflection time Tdiff. This makes it possible to accurately calculate the voltage inflection time Tdiff, which varies depending on valve-closing timing of the fuel injection valve 21, at an early timing. In the second embodiment, the voltage inflection time Tdiff is calculated with a reference timing being a timing when the injection pulse of the partial lift injection is switched from off to on.

Figure 17:
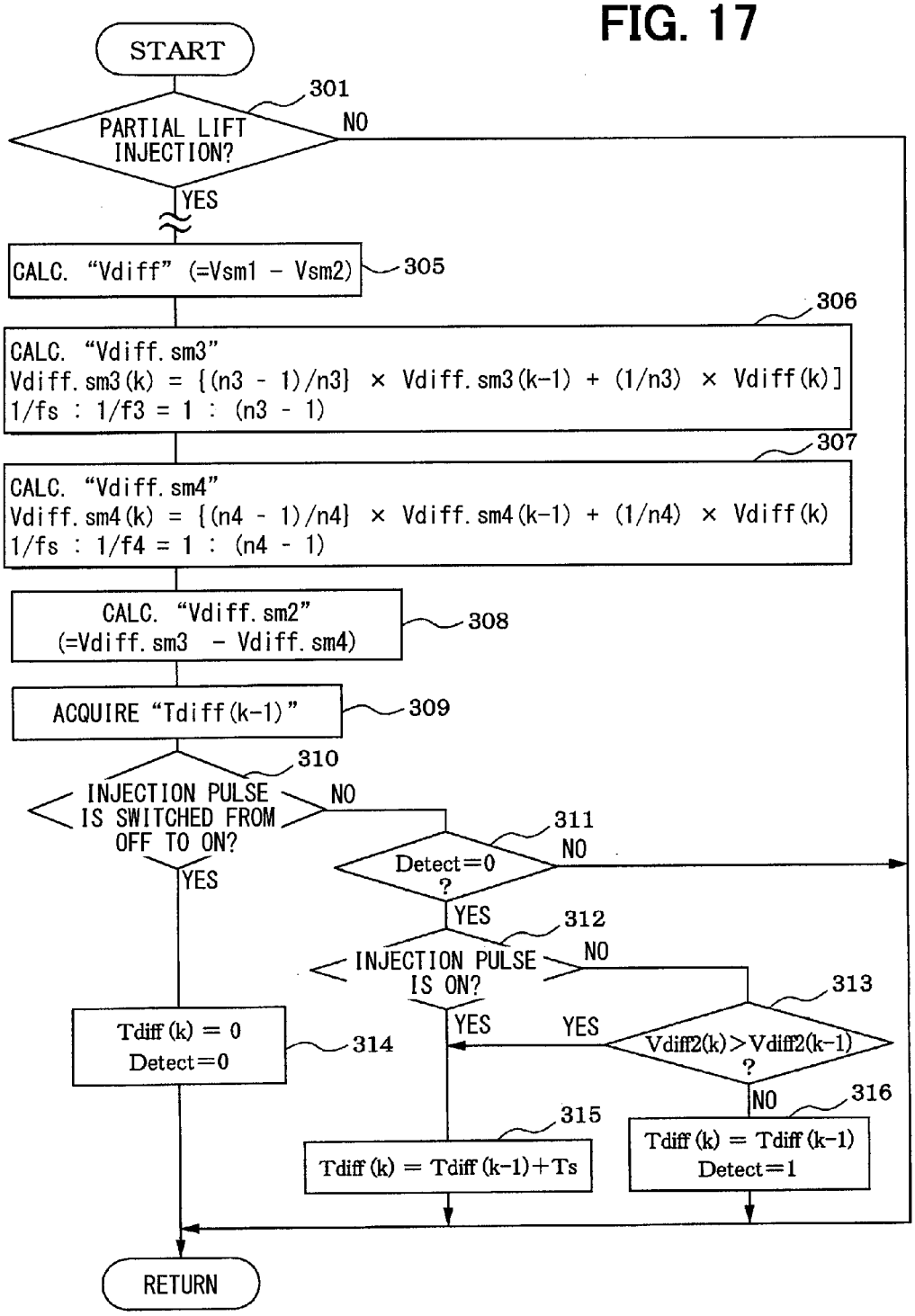
FIG. 17 is a flowchart illustrating a procedure of a voltage inflection time calculation routine in a second embodiment.
Figure 18:
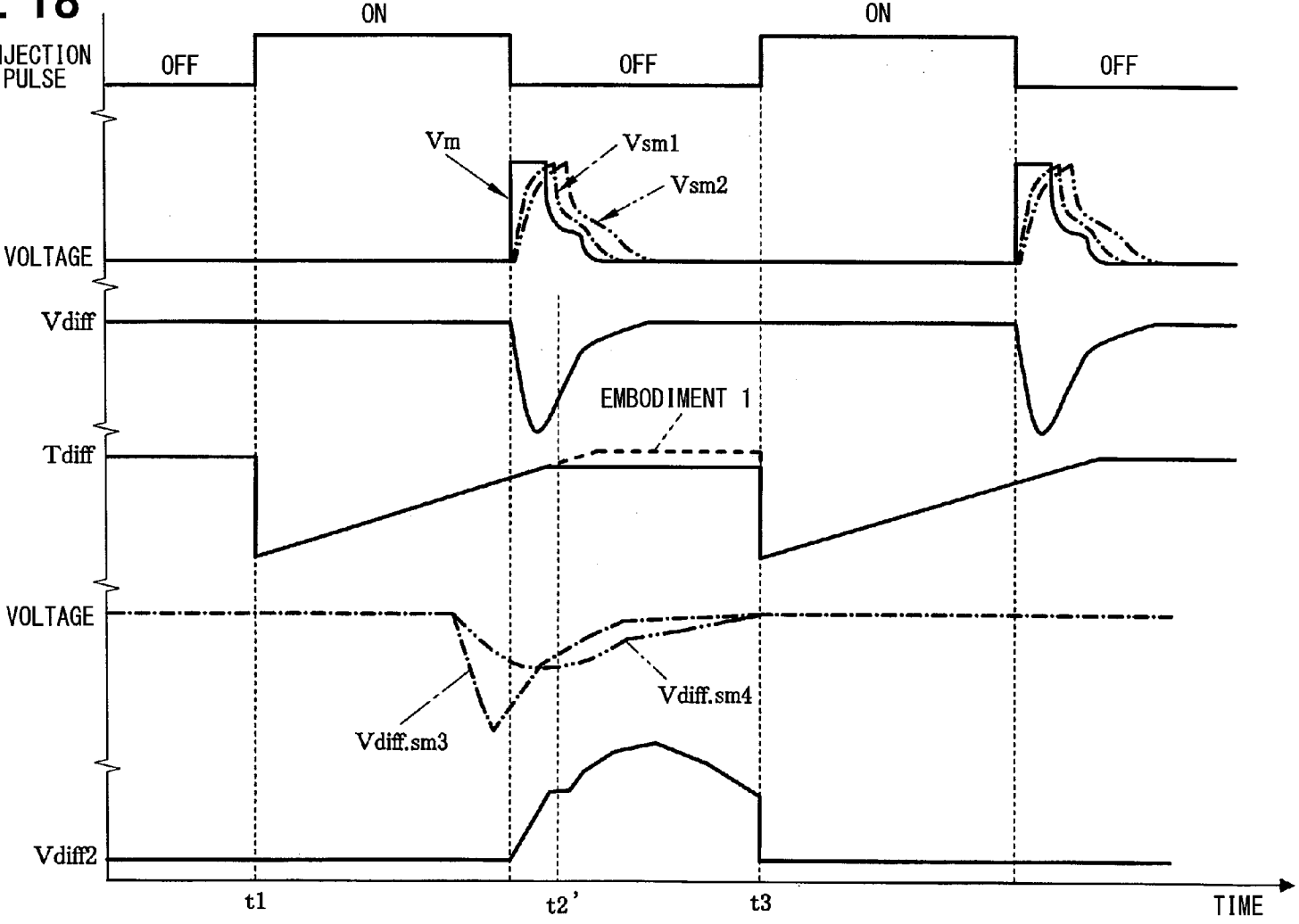
FIG. 18 is a time chart illustrating an execution example of voltage inflection time calculation in the second embodiment.

A process of steps 301 to 305 in the routine of FIG. 17 executed in the second embodiment is the same as the process of steps 101 to 105 in the routine of FIG. 12 described in the first embodiment.

In the voltage inflection time calculation routine of FIG. 17, if the partial lift injection is determined to be being performed, a first filtered voltage Vsm1 being a negative terminal voltage Vm of the fuel injection valve 21 filtered by a first low-pass filter is calculated, and a second filtered voltage Vsm2 being the negative terminal voltage Vm of the fuel injection valve 21 filtered by a second low-pass filter is calculated (steps 301 to 304). Subsequently, a difference Vdiff (=Vsm1−Vsm2) between the first filtered voltage Vsm1 and the second filtered voltage Vsm2 is calculated (step 305).

Subsequently, in step 306, there is calculated a third filtered voltage Vdiff.sm3 being the difference Vdiff filtered by a third low-pass filter having a third frequency f3 as a cutoff frequency, the third frequency f3 being lower than a frequency of a noise component (i.e., a low-pass filter having a passband being a frequency band lower than the cutoff frequency f3).

The third low-pass filter is a digital filter implemented by Formula (5) to obtain a current value Vdiff.sm3(k) of the third filtered voltage using a previous value Vdiff.sm3(k−1) of the third filtered voltage and a current value Vdiff(k) of the difference.

$$Vdiff.sm3(k)=\{(n3-1)/n3\}\times Vdiff.sm3(k-1)+(1/n3)\times Vdiff(k) \quad (5)$$

The time constant "n3" of the third low-pass filter is set such that the relationship of Formula (6) is satisfied, where "fs" (=1/Ts) is a sampling frequency of the negative terminal voltage Vm, and "f3" is the cutoff frequency of the third low-pass filter.

$$1/fs:1/f3=1:(n3-1) \quad (6)$$

Consequently, it is possible to easily calculate the third filtered voltage Vdiff.sm3 filtered by the third low-pass filter having the third frequency "f3" as the cutoff frequency, the third frequency "f3" being lower than the frequency of the noise component.

Subsequently, in step 307, a fourth filtered voltage Vdiff.sm4 being the difference Vdiff filtered by a fourth low-pass filter having a fourth frequency f4 as a cutoff frequency, the fourth frequency "f4" being lower than the third frequency "f3" (i.e., a low-pass filter having a passband being a frequency band lower than the cutoff frequency f4).

The fourth low-pass filter is a digital filter implemented by Formula (7) to obtain a current value Vdiff.sm4(k) of the fourth filtered voltage using a previous value Vdiff.sm4(k−1) of the fourth filtered voltage and the current value Vdiff(k) of the difference.

$$Vdiff.sm4(k)=\{(n4-1)/n4\}\times Vdiff.sm4(k-1)+(1/n4)\times Vdiff(k) \quad (7)$$

The time constant "n4" of the fourth low-pass filter is set such that the relationship of Formula (8) is satisfied, where "fs" (=1/Ts) is the sampling frequency of the negative terminal voltage Vm, and "f4" is the cutoff frequency of the fourth low-pass filter.

$$1/fs:1/f4=1:(n4-1) \quad (8)$$

Consequently, it is possible to easily calculate the fourth filtered voltage Vdiff.sm4 filtered by the fourth low-pass filter having the fourth frequency "f4" as the cutoff frequency, the fourth frequency "f4" being lower than the third frequency "f3".

The cutoff frequency "f3" of the third low-pass filter is set to a frequency higher than the cutoff frequency "f1" of the first low-pass filter, and the cutoff frequency "f4" of the fourth low-pass filter is set to a frequency lower than the cutoff frequency "f2" of the second low-pass filter (i.e., a relationship of f3>f1>f2>f4 is satisfied).

Subsequently, in step 308, a difference between the third filtered voltage Vdiff.sm3 and the fourth filtered voltage Vdiff.sm4 is calculated as the second order differential Vdiff2 (=Vdiff.sm3−Vdiff.sm4), and then the previous value T diff(k−1) of the voltage inflection time is acquired in step 309.

Subsequently, in step 310, whether or not the injection pulse is switched from off to on at the current timing is determined. If the injection pulse is determined to be switched from off to on at the current timing in step 310, then in step 314 a current value Tdiff(k) of the voltage inflection time is reset to "0", and a completion flag Detect is reset to "0".

$$Tdiff(k)=0$$

$$Detect(k)=0$$

If the injection pulse is determined to be switched from off to on at the current timing in step 310, then in step 311 whether or not the completion flag Detect is "0" is determined. If the completion flag Detect is determined to be "0", then in step 312 whether or not the injection pulse is on is determined.

If the injection pulse is determined to be on in step 312, then in step 315 a predetermined value Ts (the calculation period of this routine) is added to the previous value Tdiff(k−1) of the voltage inflection time to obtain the current value Tdiff(k) of the voltage inflection time, so that the voltage inflection time Tdiff is counted up.

$$Tdiff(k)=Tdiff(k-1)+Ts$$

If the injection pulse is determined to be not on (or the injection pulse is off) in step 312, then in step 313 whether or not the second order differential Vdiff2 increases is determined based on whether or not the current value Vdiff2(k) of the second order differential is larger than the previous value Vdiff2(k−1). If the second order differential Vdiff2 no longer increases, the second order differential Vdiff2 is determined to have an extreme value.

If the current value Vdiff2(k) of the second order differential is determined to be larger than the previous value Vdiff2(k−1) (the second order differential Vdiff2 is determined to increase) in step 313, then in step 315 the voltage inflection time Tdiff is continuously counted up.

If the current value Vdiff2(k) of the second order differential is determined to be equal to or smaller than the previous value Vdiff2(k−1) (the second order differential Vdiff2 is determined not to increase) in step 313, calculation of the voltage inflection time Tdiff is determined to be completed, and then in step 316 the current value Tdiff(k) of the voltage inflection time is maintained to the previous value Tdiff(k−1), and the completion flag Detect is set to "1".

$$Tdiff(k)=Tdiff(k-1)$$

$$Detect=1$$

If the completion flag Detect is determined to be 1, while the current value Tdiff(k) of the voltage inflection time is maintained to the previous value Tdiff(k−1), this routine is finished.

Consequently, time from a timing (reference timing), at which the injection pulse is switched from off to on, to a timing, at which the second order differential Vdiff2 has the extreme value (at which the second order differential Vdiff2 no longer increases), is calculated as the voltage inflection time Tdiff, and the calculated value of the voltage inflection time Tdiff is maintained until the next reference timing.

An execution example of calculation of the voltage inflection time in the second embodiment is now described with reference to a time chart of FIG. 18.

During the partial lift injection (at least after off of the injection pulse of the partial lift injection), the first filtered voltage Vsm1 and the second filtered voltage Vsm2 are calculated, and the difference Vdiff between the first filtered voltage Vsm1 and the second filtered voltage Vsm2 is calculated.

Furthermore, the third filtered voltage Vdiff.sm3 being the difference Vdiff filtered by the third low-pass filter is calculated, and the fourth filtered voltage Vdiff.sm4 being the difference Vdiff filtered by the fourth low-pass filter is calculated. In addition, a difference between the third filtered voltage Vdiff.sm3 and the fourth filtered voltage Vdiff.sm4 is calculated as a second order differential Vdiff2 (=Vdiff.sm3−Vdiff.sm4).

The voltage inflection time Tdiff is reset to "0" at a timing (reference timing) t1 when the injection pulse is switched from off to on, and then calculation of the voltage inflection time Tdiff is started, and the voltage inflection time Tdiff is repeatedly counted up with the predetermined calculation period Ts.

Subsequently, the calculation of the voltage inflection time Tdiff is completed at a timing t2' when the second order differential Vdiff2 has an extreme value (the second order differential Vdiff2 no longer increases) after off of the injection pulse. Consequently, time from the timing (reference timing) t1, at which the injection pulse is switched from off to on, to the timing t2', at which the second order differential Vdiff2 has an extreme value, is calculated as the voltage inflection time Tdiff.

The calculated value of the voltage inflection time Tdiff is maintained until the next reference timing t3, during which (during a period from the calculation completion timing t2' of the voltage inflection time Tdiff to the next reference timing t3) the engine control microcomputer 35 acquires the voltage inflection time Tdiff from the injector drive IC 36.

In the second embodiment, the third filtered voltage Vdiff.sm3 being the difference Vdiff filtered by the third low-pass filter is calculated, and the fourth filtered voltage Vdiff.sm4 being the difference Vdiff filtered by the fourth low-pass filter is calculated. In addition, the difference between the third filtered voltage Vdiff.sm3 and the fourth filtered voltage Vdiff.sm4 is calculated as the second order differential Vdiff2. The voltage inflection time Tdiff is calculated with the timing, at which the second order differential Vdiff2 has an extreme value (the second order differential Vdiff2 no longer increases), as a timing when the difference Vdiff has an inflection point. Consequently, it is possible to accurately calculate the voltage inflection time Tdiff that varies depending on the valve-closing timing of the fuel injection valve 21, and prevent the voltage inflection time Tdiff from being affected by offset of a terminal voltage waveform due to circuit variations.

Third Embodiment

A third embodiment of the disclosure is now described with reference to FIGS. 19 and 20. However, portions substantially the same as those in the first embodiment are not or briefly described, and differences from the first embodiment are mainly described.

In the first embodiment, the voltage inflection time Tdiff is calculated with the reference timing being the timing when the injection pulse of the partial lift injection is switched from off to on. In the third embodiment, the ECU 30 executes a voltage inflection time calculation routine of FIG. 19 described later to calculate the voltage inflection time Tdiff with a reference timing being a timing when the injection pulse of the partial lift injection is switched from on to off.

Figure 19:
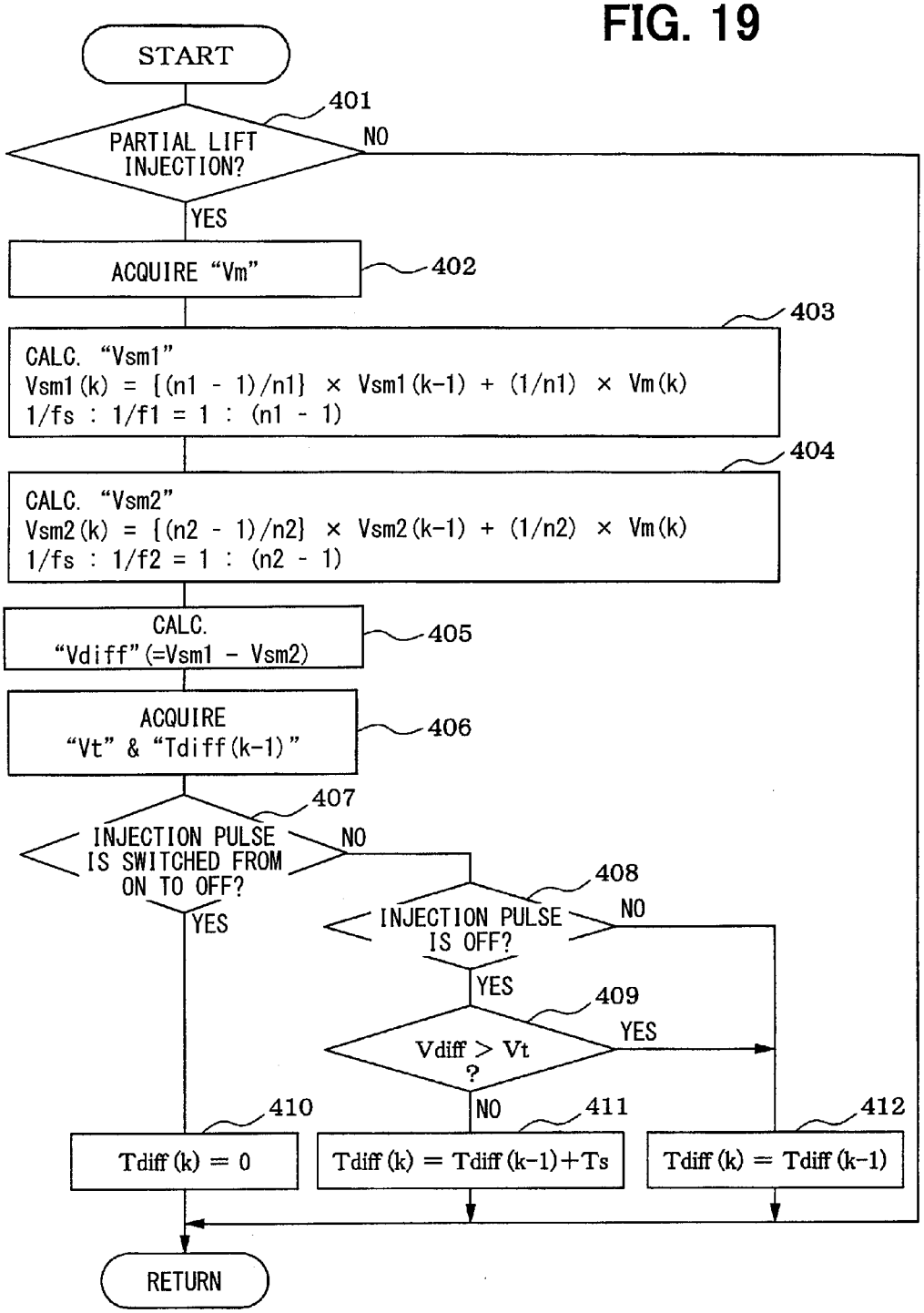
FIG. 19 is a flowchart illustrating a procedure of a voltage inflection time calculation routine in a third embodiment.
Figure 20:
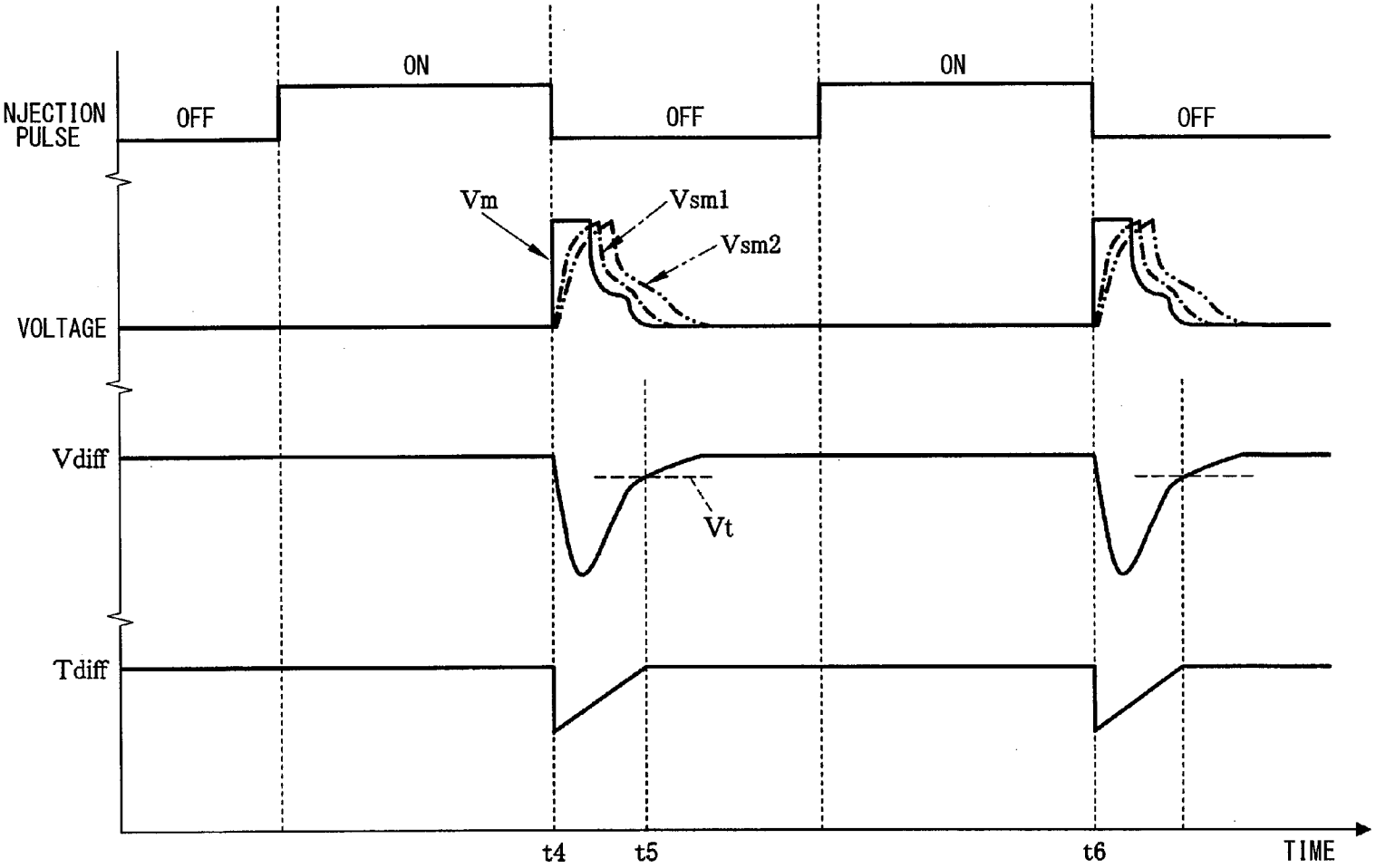
FIG. 20 is a time chart illustrating an execution example of voltage inflection time calculation in the third embodiment.

A process of steps 401 to 406 in the routine of FIG. 19 executed in the third embodiment is the same as the process of steps 101 to 106 in the routine of FIG. 12 described in the first embodiment.

In the voltage inflection time calculation routine of FIG. 19, if the partial lift injection is determined to be being performed, a first filtered voltage Vsm1 being a negative terminal voltage Vm of the fuel injection valve 21 filtered by a first low-pass filter is calculated, and a second filtered voltage Vsm2 being the negative terminal voltage Vm of the fuel injection valve 21 filtered by a second low-pass filter is calculated (steps 401 to 404).

Subsequently, a difference Vdiff between the first filtered voltage Vsm1 and the second filtered voltage Vsm2 is calculated, and then a threshold Vt and a previous value Tdiff(k−1) of the voltage inflection time are acquired (steps 405, 406).

Subsequently, in step 407, whether or not the injection pulse is switched from on to off at the current timing is determined. If the injection pulse is determined to be switched from on to off at the current timing in step 407, then in step 410 a current value Tdiff(k) of the voltage inflection time is reset to "0".

$$Tdiff(k)=0$$

If the injection pulse is determined to be switched from on to off at the current timing in step 407, then in step 408 whether or not the injection pulse is off is determined. If the injection pulse is determined to be off in step 408, then in step 409 whether or not the difference Vdiff between the first filtered voltage Vsm1 and the second filtered voltage Vsm2 exceeds the threshold Vt (whether or not the difference Vdiff inversely becomes larger than the threshold Vt) is determined.

If the difference Vdiff between the first filtered voltage Vsm1 and the second filtered voltage Vsm2 is determined not to exceed the threshold Vt in step 409, then in step 411 a predetermined value Ts (the calculation period of this routine) is added to the previous value Tdiff(k−1) of the voltage inflection time to obtain the current value Tdiff(k) of the voltage inflection time, so that the voltage inflection time Tdiff is counted up.

$$Tdiff(k)=Tdiff(k-1)+Ts$$

If the difference Vdiff between the first filtered voltage Vsm1 and the second filtered voltage Vsm2 is determined to exceed the threshold Vt in step 409, calculation of the voltage inflection time Tdiff is determined to be completed, and in step 412 the current value Tdiff(k) of the voltage inflection time is maintained to the previous value Tdiff(k−1).

$$Tdiff(k)=Tdiff(k-1)$$

Consequently, time from the timing (reference timing), at which the injection pulse is switched from on to off, to the timing, at which the difference Vdiff exceeds the threshold Vt, is calculated as the voltage inflection time Tdiff.

If the injection pulse is determined to be not off (i.e., the injection pulse is on) in step 408, the current value Tdiff(k) of the voltage inflection time is continuously maintained to the previous value Tdiff(k−1), and the calculated value of the voltage inflection time Tdiff is maintained until the next reference timing.

An execution example of calculation of the voltage inflection time in the third embodiment is now described with reference to a time chart of FIG. 20.

During the partial lift injection (at least after off of the injection pulse of the partial lift injection), the first filtered voltage Vsm1 and the second filtered voltage Vsm2 are calculated, and the difference Vdiff between the first filtered voltage Vsm1 and the second filtered voltage Vsm2 is calculated.

The voltage inflection time Tdiff is reset to "0" at a timing (reference timing) t4 when the injection pulse is switched from on to off, and then calculation of the voltage inflection time Tdiff is started, and the voltage inflection time Tdiff is repeatedly counted up with the predetermined calculation period Ts.

The calculation of the voltage inflection time Tdiff is completed at a timing t5 when the difference Vdiff between the first filtered voltage Vsm1 and the second filtered voltage Vsm2 exceeds the threshold Vt after off of the injection pulse. Consequently, time from the timing (reference timing) t4, at which the injection pulse is switched from on to off, to the timing t5, at which the difference Vdiff exceeds the threshold Vt, is calculated as the voltage inflection time Tdiff.

The calculated value of the voltage inflection time Tdiff is maintained until the next reference timing t6, during which (during a period from the calculation completion timing t5 of the voltage inflection time Tdiff to the next reference timing t6), the engine control microcomputer 35 acquires the voltage inflection time Tdiff from the injector drive IC 36.

In the third embodiment, the voltage inflection time Tdiff is calculated with the reference timing being the timing when the injection pulse of the partial lift injection is switched from on to off; hence, the voltage inflection time Tdiff can be accurately calculated with reference to the timing when the injection pulse is switched from on to off. Moreover, a period during which the calculated value of the voltage inflection time Tdiff is maintained can be lengthened compared with the case where the timing when the injection pulse is switched from off to on is used as a reference timing (first embodiment), so that the period during which the engine control microcomputer 35 can acquire the voltage inflection time Tdiff can be further lengthened.

In the third embodiment, time from the timing, at which the injection pulse is switched from off to on, to the timing, at which the difference Vdiff exceeds the threshold Vt, is calculated as the voltage inflection time Tdiff. However, time from the timing, at which the injection pulse is switched from off to on, to the timing, at which the second order differential Vdiff2 has an extreme value, may be calculated as the voltage inflection time Tdiff.

Fourth Embodiment

A fourth embodiment of the disclosure is now described with reference to FIGS. 21 and 22. However, portions substantially the same as those in the first embodiment are not or briefly described, and differences from the first embodiment are mainly described.

In the first embodiment, the voltage inflection time Tdiff is calculated with the reference timing being the timing when the injection pulse of the partial lift injection is switched from off to on. In the fourth embodiment, the ECU 30 executes a voltage inflection time calculation routine of FIG. 21 described later, so that the voltage inflection time Tdiff is calculated with a reference timing being a timing when the negative terminal voltage Vm of the fuel injection valve 21 becomes lower than a predetermined value Voff after off of the injection pulse of the partial lift injection.

Figure 21:
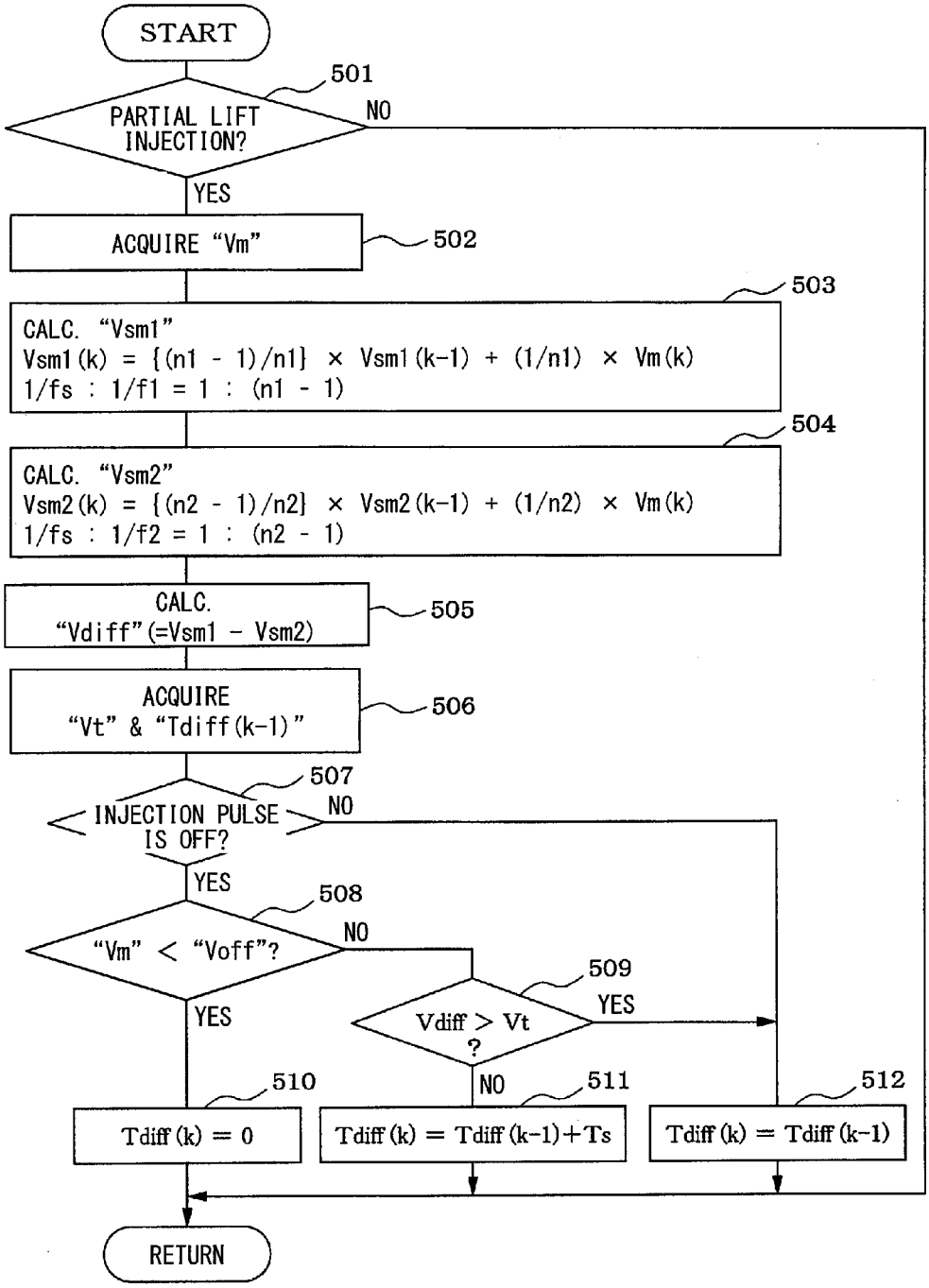
FIG. 21 is a flowchart illustrating a procedure of a voltage inflection time calculation routine in a fourth embodiment.
Figure 22:
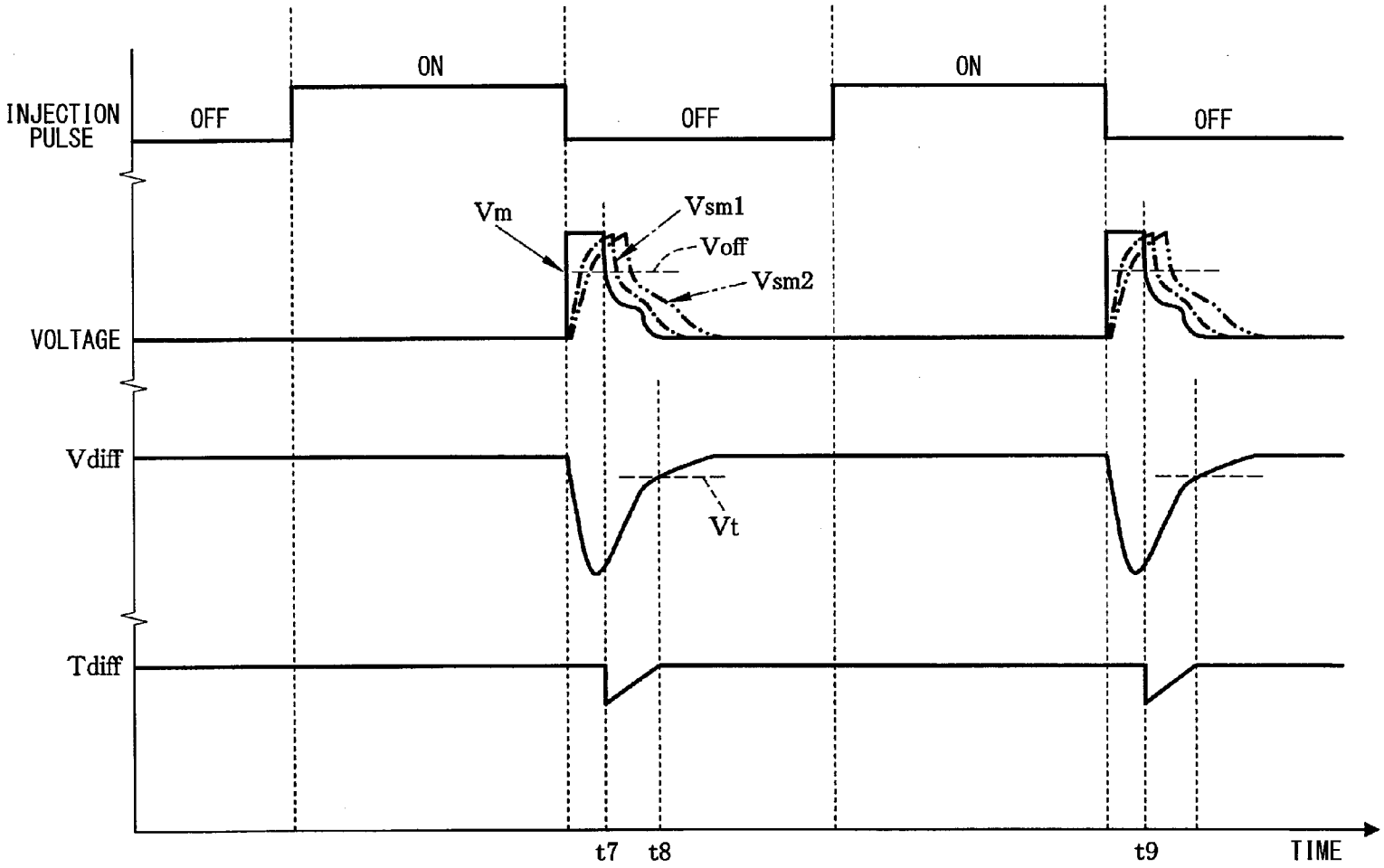
FIG. 22 is a time chart illustrating an execution example of voltage inflection time calculation in the fourth embodiment.

A process of steps 501 to 506 in the routine of FIG. 21 executed in the fourth embodiment is the same as the process of steps 101 to 106 in the routine of FIG. 12 described in the first embodiment.

In the voltage inflection time calculation routine of FIG. 21, if the partial lift injection is determined to be being performed, a first filtered voltage Vsm1 being a negative terminal voltage Vm of the fuel injection valve 21 filtered by a first low-pass filter is calculated, and a second filtered voltage Vsm2 being the negative terminal voltage Vm of the fuel injection valve 21 filtered by a second low-pass filter is calculated (steps 501 to 504).

Subsequently, a difference Vdiff between the first filtered voltage Vsm1 and the second filtered voltage Vsm2 is calculated, and then a threshold Vt and a previous value Tdiff(k−1) of the voltage inflection time are acquired (steps 505, 506).

Subsequently, in step 507, whether or not the injection pulse is off is determined. If the injection pulse is determined to be off in step 507, then in step 508 whether or not the negative terminal voltage Vm of the fuel injection valve 21 becomes lower than a predetermined value Voff (inversely becomes smaller than the predetermined value Voff) at the current timing is determined.

If the negative terminal voltage Vm of the fuel injection valve 21 is determined to become lower than the predetermined value Voff at the current timing in step 508, then in step 510 a current value Tdiff(k) of the voltage inflection time is reset to "0".

$$Tdiff(k)=0$$

If the negative terminal voltage Vm of the fuel injection valve 21 is determined not to become lower than the predetermined value Voff at the current timing in step 508, then in step 509 whether or not the difference Vdiff between the first filtered voltage Vsm1 and the second filtered voltage Vsm2 exceeds the threshold Vt (whether or not the difference Vdiff inversely becomes larger than the threshold Vt) is determined.

If the difference Vdiff between the first filtered voltage Vsm1 and the second filtered voltage Vsm2 is determined not to exceed the threshold Vt in step 509, then in step 511 a predetermined value Ts (the calculation period of this routine) is added to the previous value Tdiff(k−1) of the voltage inflection time to obtain a current value Tdiff(k) of the voltage inflection time, so that the voltage inflection time Tdiff is counted up.

$$Tdiff(k)=Tdiff(k-1)+Ts$$

If the difference Vdiff between the first filtered voltage Vsm1 and the second filtered voltage Vsm2 is determined to exceed the threshold Vt in step 509, calculation of the voltage inflection time Tdiff is determined to be completed, and in step 512 the current value Tdiff(k) of the voltage inflection time is maintained to the previous value Tdiff(k−1).

$$Tdiff(k)=Tdiff(k-1)$$

Consequently, time from the timing (reference timing), at which the negative terminal voltage Vm of the fuel injection valve 21 becomes lower than the predetermined value Voff after off of the injection pulse, to the timing, at which the difference Vdiff exceeds the threshold Vt, is calculated as the voltage inflection time Tdiff.

If the injection pulse is determined to be not off (i.e., the injection pulse is on) in step 507, the current value Tdiff(k) of the voltage inflection time is continuously maintained to the previous value Tdiff(k−1), and the calculated value of the voltage inflection time Tdiff is maintained until the next reference timing.

An execution example of calculation of the voltage inflection time in the fourth embodiment is now described with reference to a time chart of FIG. 22.

During the partial lift injection (at least after off of the injection pulse of the partial lift injection), the first filtered voltage Vsm1 and the second filtered voltage Vsm2 are calculated, and the difference Vdiff between the first filtered voltage Vsm1 and the second filtered voltage Vsm2 is calculated.

The voltage inflection time Tdiff is reset to "0" at a timing (reference timing) t7 when the negative terminal voltage Vm of the fuel injection valve 21 becomes lower than the predetermined value Voff after off of the injection pulse, and then calculation of the voltage inflection time Tdiff is started, and the voltage inflection time Tdiff is repeatedly counted up with the predetermined calculation period Ts.

The calculation of the voltage inflection time Tdiff is completed at a timing t8 when the difference Vdiff between the first filtered voltage Vsm1 and the second filtered voltage Vsm2 exceeds the threshold Vt after off of the injection pulse. Consequently, time from the timing (reference timing) t7, at which the negative terminal voltage Vm of the fuel injection valve 21 becomes lower than the predetermined value Voff after off of the injection pulse, to the timing t8, at which the difference Vdiff exceeds the threshold Vt, is calculated as the voltage inflection time Tdiff.

The calculated value of the voltage inflection time Tdiff is maintained until the next reference timing t9, during which (during a period from the calculation completion timing t8 of the voltage inflection time Tdiff to the next reference timing t9), the engine control microcomputer 35 acquires the voltage inflection time Tdiff from the injector drive IC 36.

In the fourth embodiment, the voltage inflection time Tdiff is calculated with the reference timing being the timing when the negative terminal voltage Vm of the fuel injection valve 21 becomes lower than the predetermined value Voff after off of the injection pulse of the partial lift injection; hence, the voltage inflection time Tdiff can be accurately calculated with reference to the timing when the negative terminal voltage Vm of the fuel injection valve 21 becomes lower than the predetermined value Voff after off of the injection pulse. Moreover, a period during which the calculated value of the voltage inflection time Tdiff is maintained can be lengthened compared with the case where the timing when the injection pulse is switched from off to on is used as the reference timing (first embodiment), so that the period during which the engine control microcomputer 35 can acquire the voltage inflection time Tdiff can be further lengthened.

In the fourth embodiment, time from the timing, at which the negative terminal voltage Vm becomes lower than the predetermined value Voff, to the timing, at which the difference Vdiff exceeds the threshold Vt, is calculated as the voltage inflection time Tdiff. However, time from the timing, at which the negative terminal voltage Vm becomes lower than the predetermined value Voff, to the timing, at which the second order differential Vdiff2 has an extreme value, may be calculated as the voltage inflection time Tdiff.

Fifth Embodiment

Figure 23:
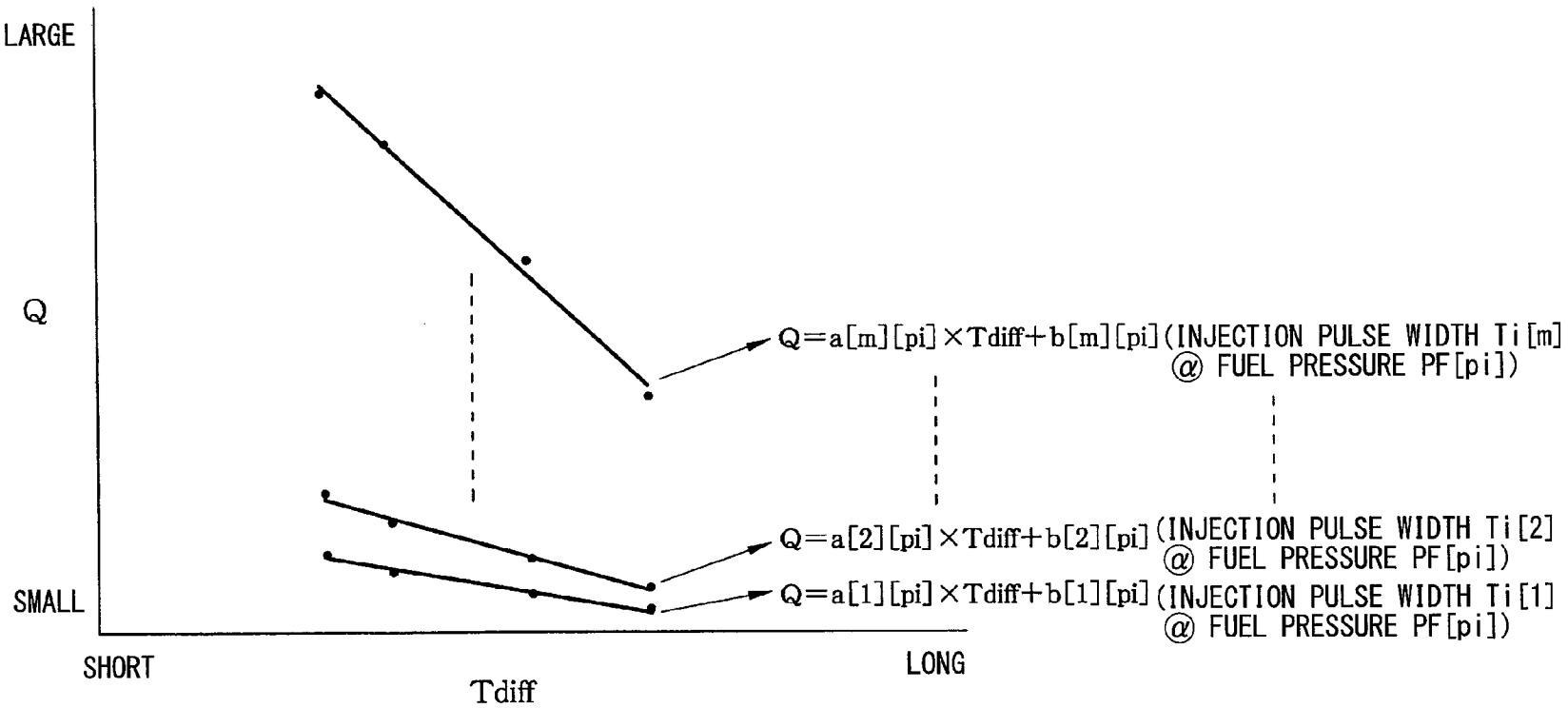
FIG. 23 is a schematic illustration of a primary expression approximating a relationship between voltage inflection time Vdiff and an injection quantity Q in a fifth embodiment.

A fifth embodiment of the disclosure is now described with reference to FIG. 23. However, portions substantially the same as those in the first embodiment are not or briefly described, and differences from the first embodiment are mainly described.

In the fifth embodiment, when the ECU 30 corrects the injection pulse of the partial lift injection based on the voltage inflection time Tdiff, the ECU 30 also takes in consideration pressure of fuel (hereinafter, referred to as "fuel pressure") supplied to the fuel injection valve 21.

In the fifth embodiment, the ECU 30 beforehand stores, for each of a plurality of fuel pressures PF, the relationship between the voltage inflection time Tdiff and the injection quantity Q (primary expression "Q=a×Tdiff+b") in the ROM 42 of the engine control microcomputer 35 for each of a plurality of injection pulse widths Ti. In this case, as illustrated in FIG. 23, the primary expression "Q=a×Tdiff+b", which approximates the relationship between the voltage inflection time Tdiff and the injection quantity Q, is beforehand produced for each of a plurality of (for example, m) injection pulse widths Ti[1] to Ti[m] based on test data or the like, and such a process is performed for each of a plurality of fuel pressures PF[1] to PF[p], and the slope a and the intercept b of the primary expression "Q=a×Tdiff+b" are stored in the ROM 42 for each of the fuel pressures PF and for each of the injection pulse widths Ti. In other words, for each of the fuel pressures PF[pi] ([pi]: [1] to [p]), the slope a and the intercept b of the primary expression "Q=a×Tdiff+b" are stored in the ROM 42 for each of the injection pulse widths Ti[mi] ([mi]: [1] to [m]).

The ECU 30, specifically the injection pulse correction calculation section 39 of the engine control microcomputer 35, performs a process for each of the cylinders of the engine 11. In the process, the ECU 30 uses the relationship between the voltage inflection time Tdiff and the injection quantity Q (primary expression "Q=a×Tdiff+b") beforehand stored in the ROM 42 for each of the fuel pressures PF and for each of the injection pulse widths Ti to estimate the injection quantity Qest corresponding to the voltage inflection time Tdiff calculated by the injector drive IC 36 (calculation section 37) for each of the fuel pressures PF and for each of the injection pulse widths Ti. Specifically, in the case of the n-cylinder engine 11, for each of a first cylinder #1 to an nth cylinder #n, the ECU 30 uses the primary expression "Q=a×Tdiff+b", which is stored for each of the fuel pressures PF and for each of the injection pulse widths Ti, to estimate (calculate) the injection quantity Qest corresponding to the voltage inflection time Tdiff of a corresponding cylinder for each of the fuel pressures PF and for each of the injection pulse widths Ti. Consequently, the ECU 30 can estimate the injection quantity Qest corresponding to the current voltage inflection time Tdiff (i.e., the voltage inflection time Tdiff reflecting the current injection characteristic of the fuel injection valve 21) for each of the fuel pressures PF and for each of the injection pulse widths Ti.

Furthermore, the ECU 30 performs a process for each of the cylinders of the engine 11, in which the relationship between the injection pulse width Ti and the injection quantity Qest is set for each of the fuel pressures PF based on a result of such estimation (a result of estimating the injection quantity Qest corresponding to the current voltage inflection time Tdiff for each of the fuel pressures PF and for each of the injection pulse widths Ti). Specifically, in the case of the n-cylinder engine 11, for each of the first cylinder #1 to the nth cylinder #n, a map defining the relationship between the injection pulse width Ti and the injection quantity Qest is created for each of the fuel pressures PF. This makes it possible to set a relationship between the injection pulse width Ti and the injection quantity Qest in correspondence to a current injection characteristic of the fuel injection valve 21 for each of the fuel pressures PF, and correct the relationship between the injection pulse width Ti and the injection quantity Qest.

Subsequently, the ECU 30 selects a map defining the relationship between the injection pulse width Ti and the injection quantity Qest for the current fuel pressure PF from among maps that are each set for the individual fuel pressure PF while defining the relationship between the injection pulse width Ti and the injection quantity Qest, and uses the map to perform a process of calculating a required injection pulse width Tireq corresponding to the required injection quantity Qreq for each of the cylinders of the engine 11. Specifically, in the case of the n-cylinder engine 11, for each of the first cylinder #1 to the nth cylinder #n, the ECU 30 uses a map (a map defining the relationship between the injection pulse width Ti and the injection quantity Qest for the current fuel pressure PF) for the corresponding cylinder to calculate the required injection pulse width Tireq corresponding to the required injection quantity Qreq. This makes it possible to accurately set a required injection pulse width Tireq necessary for achieving the required injection quantity Qreq for the current fuel pressure PF and for the current injection characteristic of the fuel injection valve 21.

Sixth Embodiment

A sixth embodiment of the disclosure is now described with reference to FIGS. 24 to 26. However, portions substantially the same as those in the first embodiment are not or briefly described, and differences from the first embodiment are mainly described.

In the sixth embodiment, the ECU 30 executes a routine that corresponds to the injection pulse correction routine of FIGS. 13 and 14 described in the first embodiment, in which however the process of FIG. 14 is replaced with a process of FIG. 24, and thereby the ECU 30 corrects the injection pulse of the partial lift injection based on the voltage inflection time Tdiff as follows.

Figure 25:
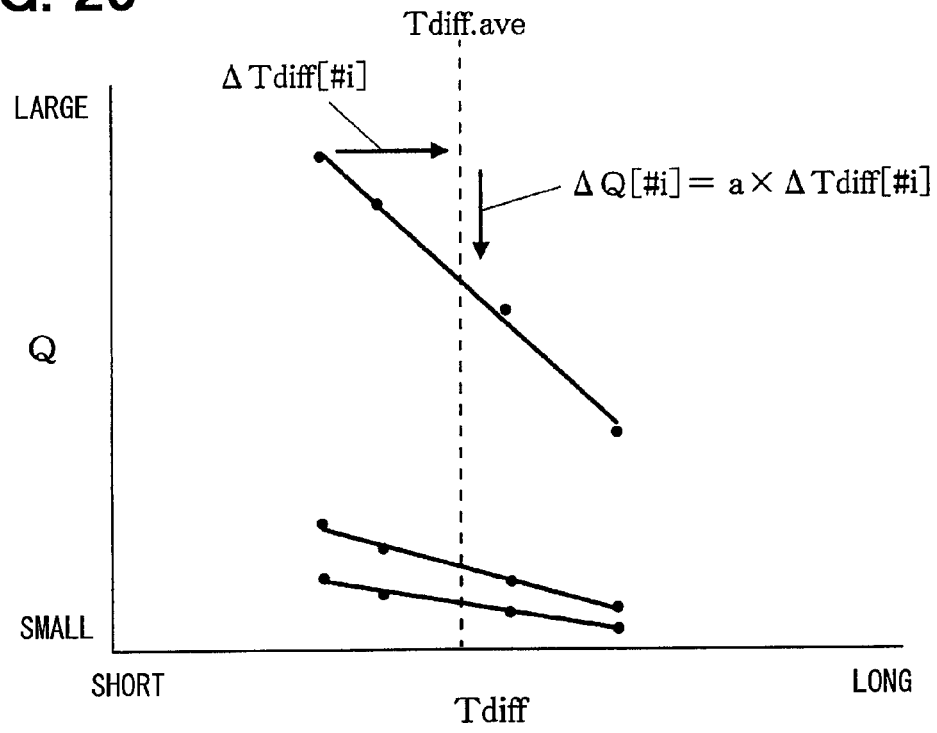
FIG. 25 is a schematic illustration of a method of calculating an injection correction amount ΔQ.

As illustrated in FIG. 25, the ECU 30, specifically the injection pulse correction calculation section 39 of the engine control microcomputer 35, calculates an average Tdiff.ave of values of voltage inflection time Tdiff for all cylinders, and calculates a deviation ΔTdiff[#i] between the voltage inflection time Tdiff[#i] ([#i]: [#1] to [#n]) and the average Tdiff.ave for each of the cylinders (the first cylinder #1 to the nth cylinder #n). The ECU 30 calculates the injection correction amount ΔQ[#i] for each cylinder based on the deviation ΔTdiff[#i] and the relationship between the voltage inflection time Tdiff and the injection quantity Qest (for example, the slope a of the primary expression "Q=a×Tdiff+b") beforehand stored in the ROM 42.

$$\Delta Q[\#i]=\Delta T\mathrm{diff}[\#i]\times a$$

Figure 26:
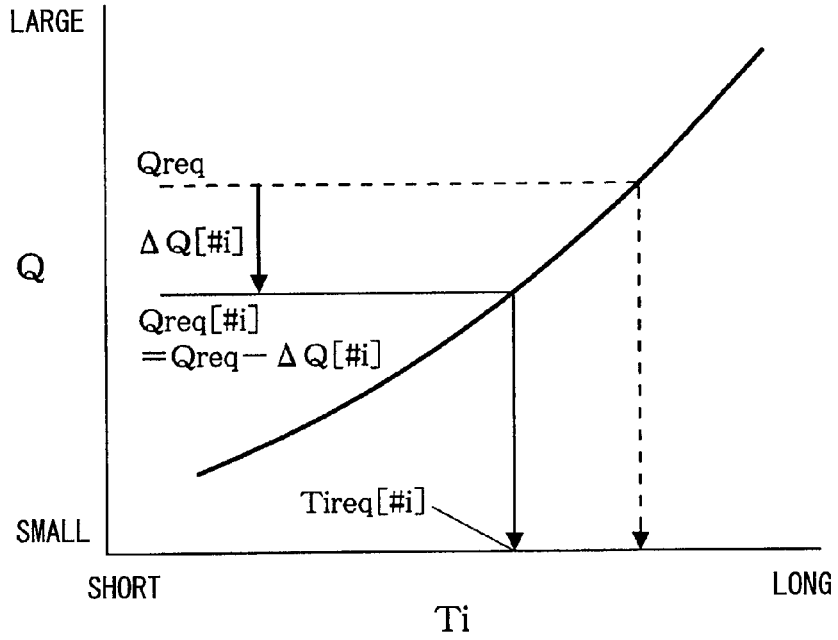
FIG. 26 is a schematic illustration of a method of correcting an injection pulse using the injection correction amount ΔQ.

Subsequently, as illustrated in FIG. 26, the ECU 30 corrects the required injection quantity Qreq with the injection correction amount ΔQ[#i] to obtain a corrected required-injection-quantity Qreq[#i]=Qreq−ΔQ[#i] for each cylinder, and calculates a required injection pulse width Tireq corresponding to the corrected required-injection-quantity Qreq[#i].

Figure 24:
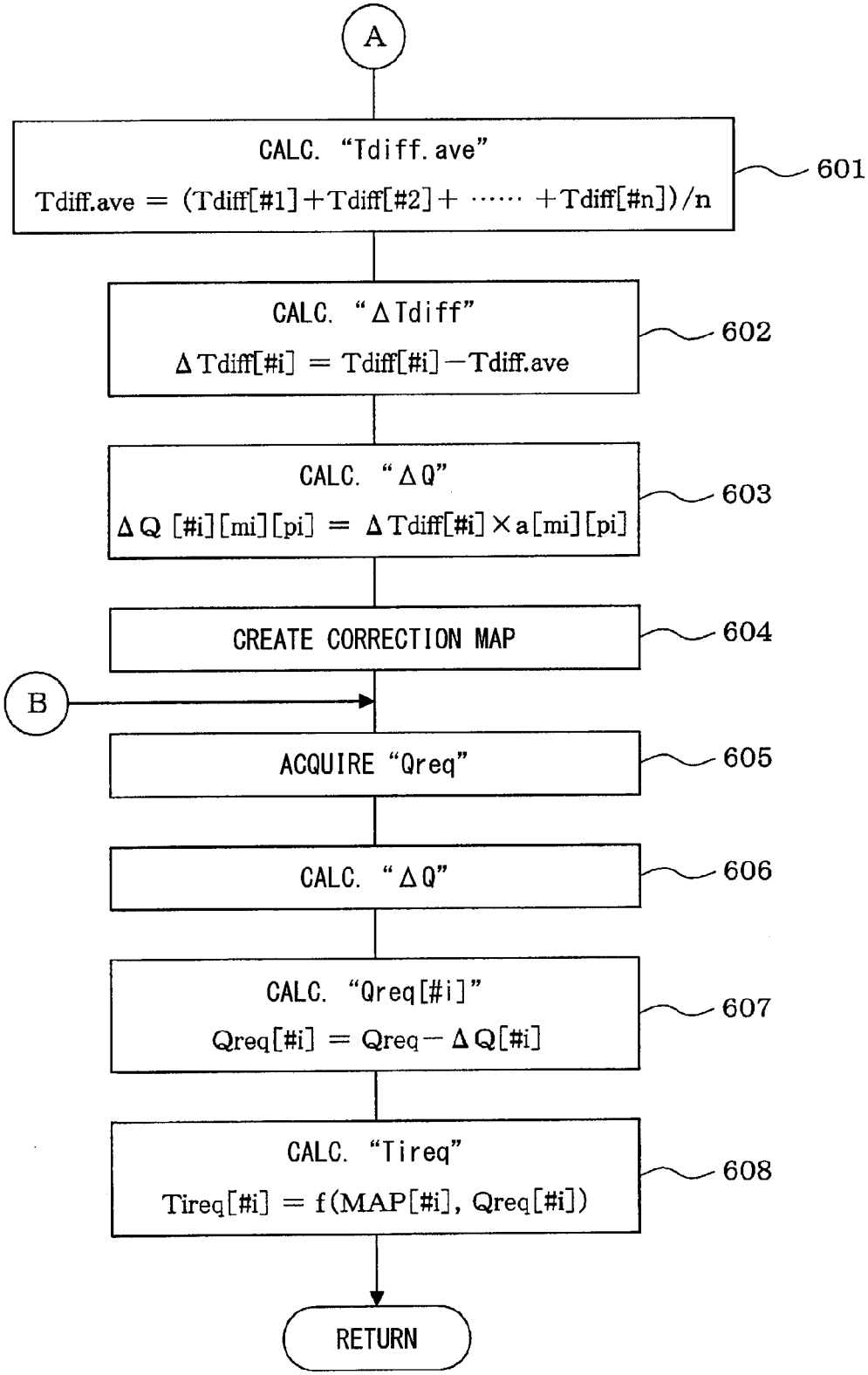
FIG. 24 is a flowchart illustrating a procedure of a major part of an injection pulse correction routine in a sixth embodiment.

Processing details of the routine of FIG. 24 executed by the ECU 30 in the sixth embodiment are now described.

The ECU 30 acquires values of the voltage inflection time Tdiff[#1] to Tdiff[#n] for the cylinders (the first cylinder #1 to the nth cylinder #n) in step 204 of FIG. 13, and then in step 601 of FIG. 24 calculates the average Tdiff.ave of the values of the voltage inflection time Tdiff[#1] to Tdiff[#n] for all the cylinders.

$$T\mathrm{diff.ave}=(T\mathrm{diff}[\#1]+T\mathrm{diff}[\#2]+\ldots+T\mathrm{diff}[\#n])/n$$

Subsequently, in step 602, the ECU 30 calculates the deviation ΔTdiff[#i] between the voltage inflection time Tdiff[#i] and the average Tdiff.ave for each of the cylinders (the first cylinder #1 to the nth cylinder #n).

$$\Delta T\mathrm{diff}[\#i]=T\mathrm{diff}[\#i]-T\mathrm{diff.ave}$$

Subsequently, in step 603, the ECU 30 calculates, for each of the cylinders (the first cylinder #1 to the nth cylinder #n), an injection correction amount ΔQ[#i][mi][pi] for each fuel pressure PF[pi] and for each injection pulse width Ti[mi] based on the deviation ΔTdiff[#i] and the slope a[mi][pi] of the primary expression "Q=a×Tdiff+b" beforehand stored in the ROM 42 for each fuel pressure PF[pi] and for each injection pulse width Ti[mi].

$$\Delta Q[\#i][mi][pi]=\Delta T\mathrm{diff}[\#i]\times a[mi][pi]$$

Subsequently, in step 604, the ECU 30 uses the calculation result of step 603 (the injection correction amount ΔQ[#i][mi][pi] for each fuel pressure PF[pi] and for each injection pulse width Ti[mi]) to create an injection correction amount map that defines a relationship between the fuel pressure PF, the injection pulse width Ti, and the injection correction amount ΔQ for each of the cylinders (the first cylinder #1 to the nth cylinder #n).

Subsequently, in step 605, the ECU 30 acquires the required injection quantity Qreq, and then in step 606, for each of the cylinders (the first cylinder #1 to the nth cylinder #n), the ECU 30 uses the injection correction amount map (a map defining the relationship between the fuel pressure PF, the injection pulse width Ti, and the injection correction amount ΔQ) for a corresponding cylinder to calculate the current injection correction amount ΔQ[#i] corresponding to the current fuel pressure PF and the current injection pulse width Ti.

Subsequently, in step 607, the ECU 30 corrects the required injection quantity Qreq using the injection correction amount ΔQ[#i] to obtain the corrected required-injection-quantity Qreq[#i] for each of the cylinders (the first cylinder #1 to the nth cylinder #n).

$$Q\mathrm{req}[\#i]=Q\mathrm{req}-\Delta Q[\#i]$$

Subsequently, in step 608, for each of the cylinders (the first cylinder #1 to the nth cylinder #n), the ECU 30 uses a standard injection characteristic map (a map defining the relationship between the injection pulse width Ti and the injection quantity Qest of a standard fuel injection valve 21) to calculate the required injection pulse width Tireq[#i] corresponding to the corrected required-injection-quantity Qreq[#i].

In the sixth embodiment, the injection correction amount ΔQ is calculated for each cylinder based on the deviation ΔTdiff of the voltage inflection time Tdiff for each cylinder from the average Tdiff.ave and the slope a of the primary expression "Q=a×Tdiff+b" beforehand stored in the ROM 42. The required injection quantity Qreq is corrected using the injection correction amount ΔQ to obtain the corrected required-injection-quantity Qreq[#i] for each cylinder, and the required injection pulse width Tireq corresponding to the corrected required-injection-quantity Qreq[#i] is calculated for each cylinder. This also makes it possible to accurately set the required injection pulse width Tireq necessary for achieving the required injection quantity Qreq for the current injection characteristic of the fuel injection valve 21. Consequently, it is possible to accurately correct a variation in injection quantity due to a variation in lift amount in the partial lift region, and reduce a variation in injection quantity between cylinders.

Seventh Embodiment

A seventh embodiment of the disclosure is now described with reference to FIGS. 27 to 29. However, portions substantially the same as those in the first embodiment are not or briefly described, and differences from the first embodiment are mainly described.

In the seventh embodiment, the ECU 30 executes a routine that corresponds to the injection pulse correction routine of FIGS. 13 and 14 described in the first embodiment, in which however the process of FIG. 14 is replaced with a process of FIG. 27, and thereby the ECU 30 corrects the injection pulse of the partial lift injection based on the voltage inflection time Tdiff as follows.

The ECU 30 beforehand stores, for each of a plurality of fuel pressures PF, the relationship between the voltage inflection time Tdiff and the injection quantity Q in the ROM 42 of the engine control microcomputer 35 for each of a plurality of injection pulse widths Ti. In the seventh embodiment, a secondary expression "$Q=a\times(Tdiff)^2+b\times Tdiff+c$", which approximates the relationship between the voltage inflection time Tdiff and the injection quantity Q, is used as a representation of the relationship between the voltage inflection time Tdiff and the injection quantity Q. In this case, as illustrated in FIG. 28, a process is beforehand performed for each of a plurality of (for example, p) fuel pressures PF[1] to PF[p], in which the secondary expression "$Q=a\times(Tdiff)^2+b\times Tdiff+c$", which approximates the relationship between the voltage inflection time Tdiff and the injection quantity Q, is beforehand produced for each of a plurality of (for example, m) injection pulse widths Ti[1] to Ti[m] based on test data or the like. In addition, the constants a to c of the terms of the secondary expression "$Q=a\times(Tdiff)^2+b\times Tdiff+c$" are beforehand stored in the ROM 42 for each fuel pressure PF and for each injection pulse width Ti. In other words, for each of the fuel pressures PF[pi], the constants "a" to "c" of the terms of the secondary expression "$Q=a\times(Tdiff)^2+b\times Tdiff+c$" are beforehand stored in the ROM 42 for each injection pulse width Ti[mi].

The ECU 30, specifically an injection pulse correction calculation section 39 of the engine control microcomputer 35, performs a process for each of the cylinders of the engine 11. In the process, the ECU 30 uses the relationship between the voltage inflection time Tdiff and the injection quantity Q (the secondary expression "$Q=a\times(Tdiff)^2+b\times Tdiff+c$") beforehand stored in the ROM 42 for each fuel pressure PF and for each injection pulse width Ti to estimate, for each fuel pressure PF and for each injection pulse width Ti, the injection quantity Qest corresponding to the voltage inflection time Tdiff calculated by the injector drive IC 36 (calculation section 37).

Subsequently, the ECU 30 calculates, for each cylinder, variation rate Qgain[#i] of the injection quantity Qest[#i] of each of the cylinders (the first cylinder #1 to the nth cylinder #n) with respect to the required injection quantity Qreq.

$$Qgain[\#i]=Qest[\#i]/Qreq$$

Figure 29:
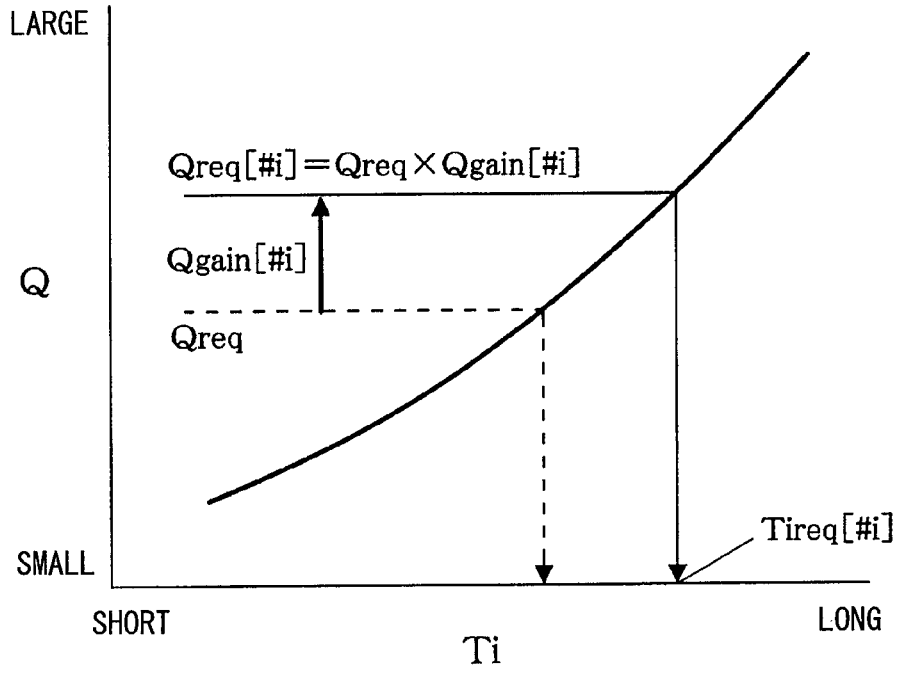
FIG. 29 is a schematic illustration of a method of correcting an injection pulse using variation rate Qgain.

Subsequently, as illustrated in FIG. 29, the ECU 30 corrects the required injection quantity Qreq using the variation rate Qgain, and thus obtains the corrected required-injection-quantity Qreq[#i]=Qreq×Qgain for each cylinder, and calculates the required injection pulse width Tireq corresponding to the corrected required-injection-quantity Qreq[#i] for each cylinder.

Figure 27:
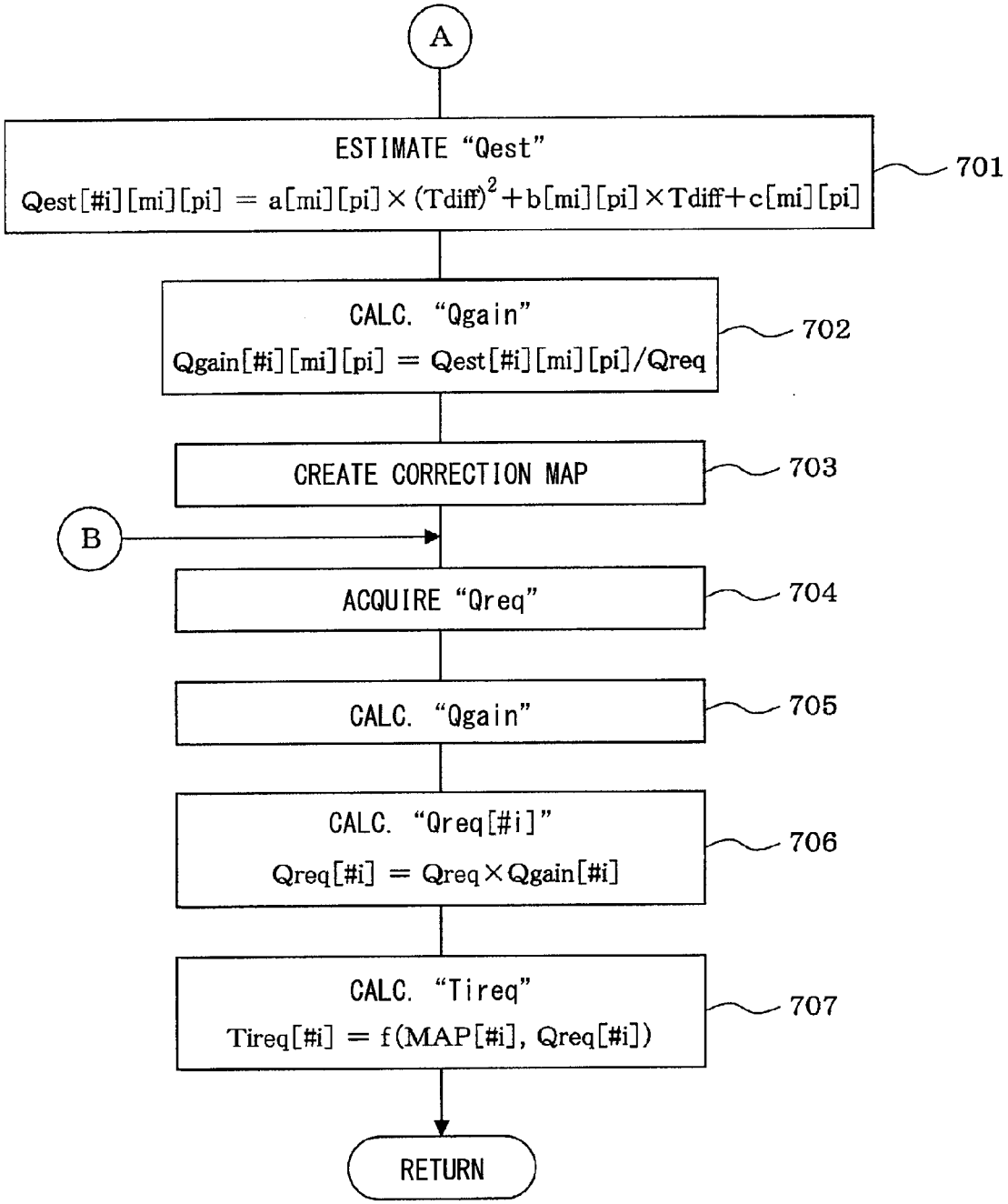
FIG. 27 is a flowchart illustrating a procedure of a major part of an injection pulse correction routine in a seventh embodiment.
Figure 28:
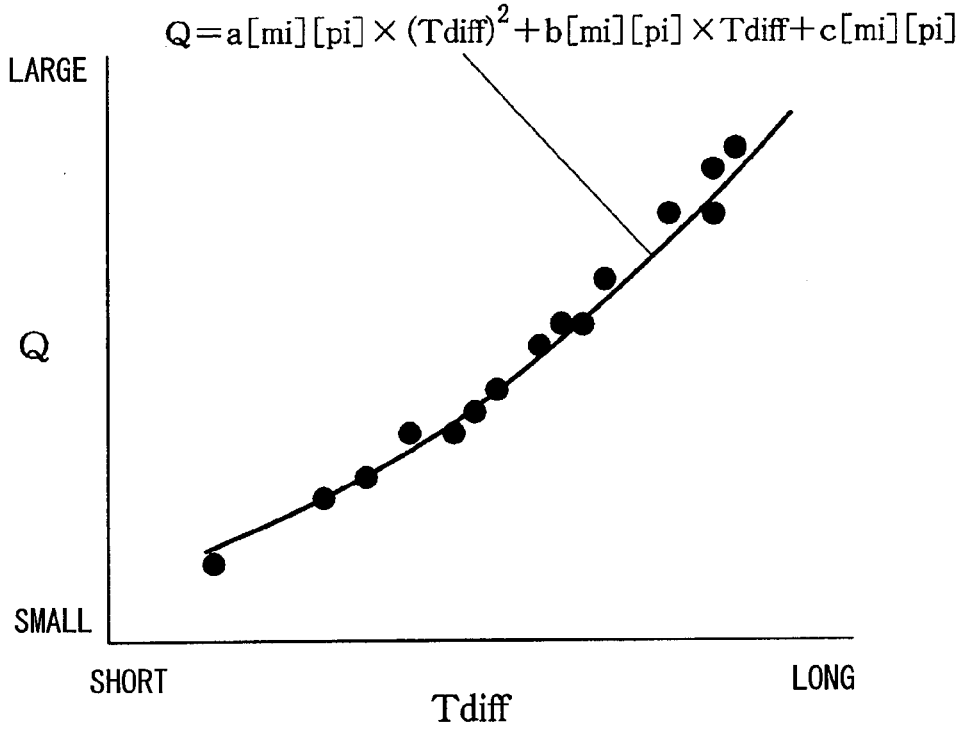
FIG. 28 is a schematic illustration of a secondary expression approximating a relationship between voltage inflection time Vdiff and an injection quantity Q.

Processing details of the routine of FIG. 27 executed by the ECU 30 in the seventh embodiment are now described.

The ECU 30 acquires the voltage inflection time Tdiff[#1] to Tdiff[#n] for the cylinders (the first cylinder #1 to the nth cylinder #n) in step 204 of FIG. 13, and then in step 701 of FIG. 27, for each of the cylinders (the first cylinder #1 to the nth cylinder #n), the ECU 30 uses the secondary expression "$Q=a\times(Tdiff)^2+b\times Tdiff+c$" stored for each fuel pressure PF[pi] and for each injection pulse width Ti[mi] to estimate (calculate) the injection quantity Qest[#i][mi][pi] corresponding to the voltage inflection time Tdiff for a corresponding cylinder for each fuel pressure PF[pi] and for each injection pulse width Ti[mi].

$$Qest[\#i][mi][pi]=a[mi][pi]\times(Tdiff)^2+b[mi][pi]\times Tdiff+c[mi][pi]$$

Subsequently, in step 702, for each of the cylinders (the first cylinder #1 to the nth cylinder #n), the ECU 30 calculates the variation rate Qgain[#i][mi][pi] of the injection quantity Qest[#i][mi][pi] with respect to the required injection quantity Qreq for each fuel pressure PF[pi] and for each injection pulse width Ti[mi].

$$Qgain[\#i][mi][pi]=Qest[\#i][mi][pi]/Qreq$$

Subsequently, in step 703, the ECU 30 uses the calculation result of step 702 (the variation rate Qgain[#i][mi][pi] for each fuel pressure PF[pi] and for each injection pulse width Ti[mi]) to create a variation rate map that defines a relationship between the fuel pressure PF, the injection pulse width Ti, and the variation rate Qgain for each of the cylinders (the first cylinder #1 to the nth cylinder #n).

Subsequently, in step 704, the ECU 30 acquires the required injection quantity Qreq, and then in step 705, for each of the cylinders (the first cylinder #1 to the nth cylinder #n), the ECU 30 uses the variation rate map (the map defining the relationship between the fuel pressure PF, the injection pulse width Ti, and the variation rate Qgain) for a corresponding cylinder to calculate the current variation rate Qgain[#i] corresponding to the current fuel pressure PF and the current injection pulse width Ti.

Subsequently, in step 706, the ECU 30 corrects the required injection quantity Qreq using the variation rate Qgain[#i] to obtain the corrected required-injection-quantity Qreq[#i] for each of the cylinders (the first cylinder #1 to the nth cylinder #n).

$$Qreq[\#i]=Qreq\times Qgain[\#i]$$

Subsequently, in step 707, for each of the cylinders (the first cylinder #1 to the nth cylinder #n), the ECU 30 uses a standard injection characteristic map (a map defining the relationship between the injection pulse width Ti and the injection quantity Qest of a standard fuel injection valve 21) to calculate the required injection pulse width Tireq[#i] corresponding to the corrected required-injection-quantity Qreq[#i].

In the seventh embodiment, the injection quantity Qest corresponding to the current voltage inflection time Tdiff is estimated using the relationship between the voltage inflection time Tdiff and the injection quantity Q (the secondary expression "$Q=a\times(Tdiff)^2+b\times Tdiff+c$") beforehand stored in the ROM 42, and the variation rate Qgain of the injection quantity Qest with respect to the required injection quantity Qreq is calculated for each cylinder. The required injection quantity Qreq is corrected using the variation rate Qgain to obtain the corrected required-injection-quantity Qreq[#i] for each cylinder, and the required injection pulse width Tireq corresponding to the corrected required-injection-quantity Qreq[#i] is calculated for each cylinder. This also makes it possible to accurately set the required injection pulse width Tireq necessary for achieving the required injection quantity Qreq for the current injection characteristic of the fuel injection valve 21. Consequently, it is possible to accurately correct a variation in injection quantity due to a variation in lift amount in the partial lift region.

In the seventh embodiment, the secondary expression "$Q=a\times(Tdiff)^2+b\times Tdiff+c$", which approximates the relationship between the voltage inflection time Tdiff and the injection quantity Q, is used as a representation of the relationship between the voltage inflection time Tdiff and the injection quantity Q; hence, the relationship between the voltage inflection time Tdiff and the injection quantity Q can be accurately approximated while the relationship between the voltage inflection time Tdiff and the injection quantity Q is expressed by a relatively simple numerical expression.

Furthermore, in the seventh embodiment, the constants a to c of the terms of the secondary expression "$Q=a\times(Tdiff)^2+b\times Tdiff+c$" are beforehand stored in the ROM 42 for each fuel pressure PF and for each injection pulse width Ti; hence, it is possible to reduce storage data volume (memory usage) necessary for storing the relationship between the voltage inflection time Tdiff and the injection quantity Q (the secondary expression).

In the seventh embodiment, the secondary expression, which approximates the relationship between the voltage inflection time Tdiff and the injection quantity Q, is used as a representation of the relationship between the voltage inflection time Tdiff and the injection quantity Q. This however is not limitative, and a primary expression or a cubic or higher polynomial, which approximates the relationship between the voltage inflection time Tdiff and the injection quantity Q, may be used.

In the first to sixth embodiments, the primary expression, which approximates the relationship between the voltage inflection time Tdiff and the injection quantity Q, is used as a representation of the relationship between the voltage inflection time Tdiff and the injection quantity Q. This however is not limitative, and a quadratic or higher polynomial, which approximates the relationship between the voltage inflection time Tdiff and the injection quantity Q, may be used.

In the first to seventh embodiments, the voltage inflection time Tdiff, which is calculated when the partial lift injection is performed with one typical injection pulse width Ti(x) among the injection pulse widths each providing the partial lift injection, is used for correction of the injection pulse. This however is not limitative, and it is also possible to use the voltage inflection time Tdiff calculated when the partial lift injection is performed with an injection pulse width corresponding to the current operation state.

Eighth Embodiment

An eighth embodiment of the disclosure is now described with reference to FIGS. 30 and 31. However, portions substantially the same as those in the first embodiment are not or briefly described, and differences from the first embodiment are mainly described.

Figure 30:
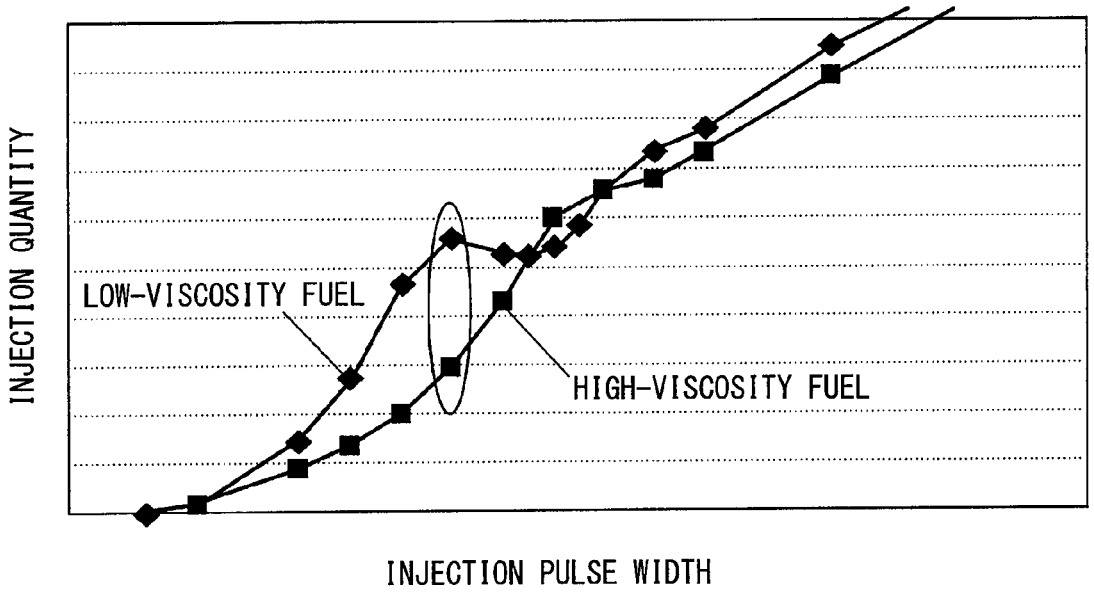
FIG. 30 is a schematic illustration of a variation in injection characteristic due to a difference in viscosity of fuel.

As illustrated in FIG. 30, an injection characteristic (the relationship between the injection pulse width and the injection quantity) of the fuel injection valve 21 tends to vary depending on a fuel property (for example, viscosity of fuel) in the partial lift region of the fuel injection valve 21. In some case, therefore, a new type of fuel is supplied into a fuel tank, so that fuel having a different property is supplied to the fuel injection valve 21. In such a case, if the same injection characteristic map (a map defining the relationship between the injection pulse width and the injection quantity) is used to calculate the required injection pulse width corresponding to the required injection quantity, control accuracy of the injection quantity may be degraded.

To overcome such a difficulty, in the eighth embodiment, the ECU 30 (for example, the engine control microcomputer 35) executes an injection characteristic map modification routine of FIG. 31 described later. Thus, a fuel property is determined based on the voltage inflection time Tdiff calculated by the injector drive IC 36 during the partial lift injection, and the injection characteristic (for example, the injection characteristic map) of the fuel injection valve 21 used for calculation of the injection pulse is modified depending on the fuel property.

The voltage inflection time Tdiff varies depending on the fuel property; hence, the fuel property can be accurately determined through monitoring the voltage inflection time Tdiff. Hence, the fuel property is determined based on the voltage inflection time Tdiff, and the injection characteristic map (the injection characteristic of the fuel injection valve 21 used for calculation of the injection pulse) is modified depending on the determined fuel property. Consequently, even if the injection characteristic of the fuel injection valve 21 varies due to a variation in the fuel property, the injection characteristic map can be modified in correspondence to the variation in the injection characteristic.

In the eighth embodiment, the engine control microcomputer 35 serves as a modification means.

Figure 31:
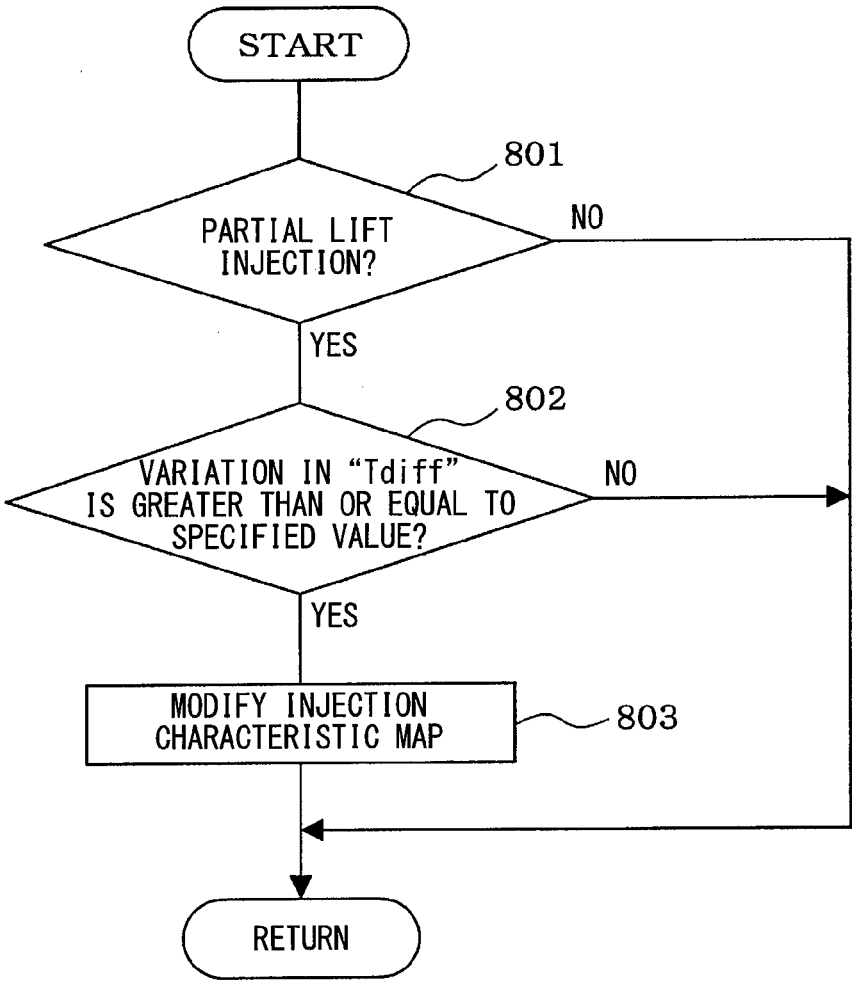
FIG. 31 is a flowchart illustrating a procedure of an injection characteristic map change routine in an eighth embodiment.

Processing details of the injection characteristic map modification routine of FIG. 31 executed by the ECU 30 in the eighth embodiment are now described.

The injection characteristic map modification routine illustrated in FIG. 31 is repeatedly executed with a predetermined calculation period during power-on of the ECU 30. When this routine is started, whether or not the partial lift injection is being performed is determined in step 801. If the partial lift injection is determined to be not being performed in step 801, the routine is finished while step 802 and subsequent steps are not executed.

If the partial lift injection is determined to be being performed in step 801, then in step 802 it is determined that whether or not a variation amount of the voltage inflection time Tdiff, which is calculated by the injector drive IC 36, between before and after fuel supply has an absolute value equal to or larger than a predetermined value.

In this case, for example, a difference between the voltage inflection time Tdiff immediately before current fuel supply (for example, immediately before engine operation stop before the current fuel supply) and the voltage inflection time Tdiff after the lapse of a predetermined period from the current fuel supply is obtained as the variation amount of the voltage inflection time Tdiff between before and after fuel supply. The predetermined period, which is longer than a period necessary for the fuel in a fuel tank to reach the fuel injection valve 21, is set based on an integrated value of a fuel injection quantity, fuel injection frequency, and engine operation time, for example.

Alternatively, a difference between the voltage inflection time Tdiff immediately after current fuel supply (for example, immediately after engine operation start after the current fuel supply) and the voltage inflection time Tdiff after the lapse of a predetermined period from the current fuel supply may be obtained as the variation amount of the voltage inflection time Tdiff between before and after fuel supply.

Alternatively, a difference between the voltage inflection time Tdiff after the lapse of a predetermined period from the previous fuel supply and the voltage inflection time Tdiff after the lapse of a predetermined period from the current fuel supply may be obtained as the variation amount of the voltage inflection time Tdiff between before and after fuel supply.

If the absolute value of the variation amount of voltage inflection time Tdiff between before and after fuel supply is determined to be equal to or larger than the predetermined value in step 802, the fuel property is determined to have varied, and in step 803, the fuel property is determined based on the variation amount of the voltage inflection time Tdiff between before and after fuel supply, and the injection characteristic map is modified in correspondence to the fuel property.

For example, a corresponding injection characteristic map (a map defining the relationship between the injection pulse width and the injection quantity) is beforehand stored in the ROM 42 of the engine control microcomputer 35 for each of a plurality of fuel properties. In addition, a fuel property determination value is varied depending on the variation amount of the voltage inflection time Tdiff between before and after fuel supply (a previous fuel property determination value is corrected with a correction amount corresponding to the variation amount to obtain a current fuel property determination value). Subsequently, an injection characteristic map corresponding to the current fuel property determination value is selected from among a plurality of injection characteristic maps.

The engine control microcomputer 35 of the ECU 30 uses the selected injection characteristic map to calculate a required injection pulse width corresponding to the required injection quantity.

In the eighth embodiment, focusing on the fact that the voltage inflection time Tdiff varies depending on the fuel property, during the partial lift injection, the fuel property is determined based on the voltage inflection time Tdiff, and the injection characteristic map is modified depending on the fuel property. Consequently, even if the injection characteristic of the fuel injection valve 21 varies due to a variation in fuel property, the injection characteristic map can be correspondingly modified, making it possible to prevent or suppress degradation in control accuracy of the injection quantity due to the variation in fuel property in the partial lift region.

In the eighth embodiment, when the variation amount of the voltage inflection time Tdiff between before and after fuel supply has a value equal to or higher than a predetermined value, the injection characteristic map is modified. Consequently, it is possible to avoid erroneous modification of the injection characteristic map when the voltage inflection time Tdiff is varied by a factor other than the variation in fuel property due to fuel supply.

Ninth Embodiment

A ninth embodiment of the disclosure is now described with reference to FIG. 32. However, portions substantially the same as those in the first embodiment are not or briefly described, and differences from the first embodiment are mainly described.

Figure 32:
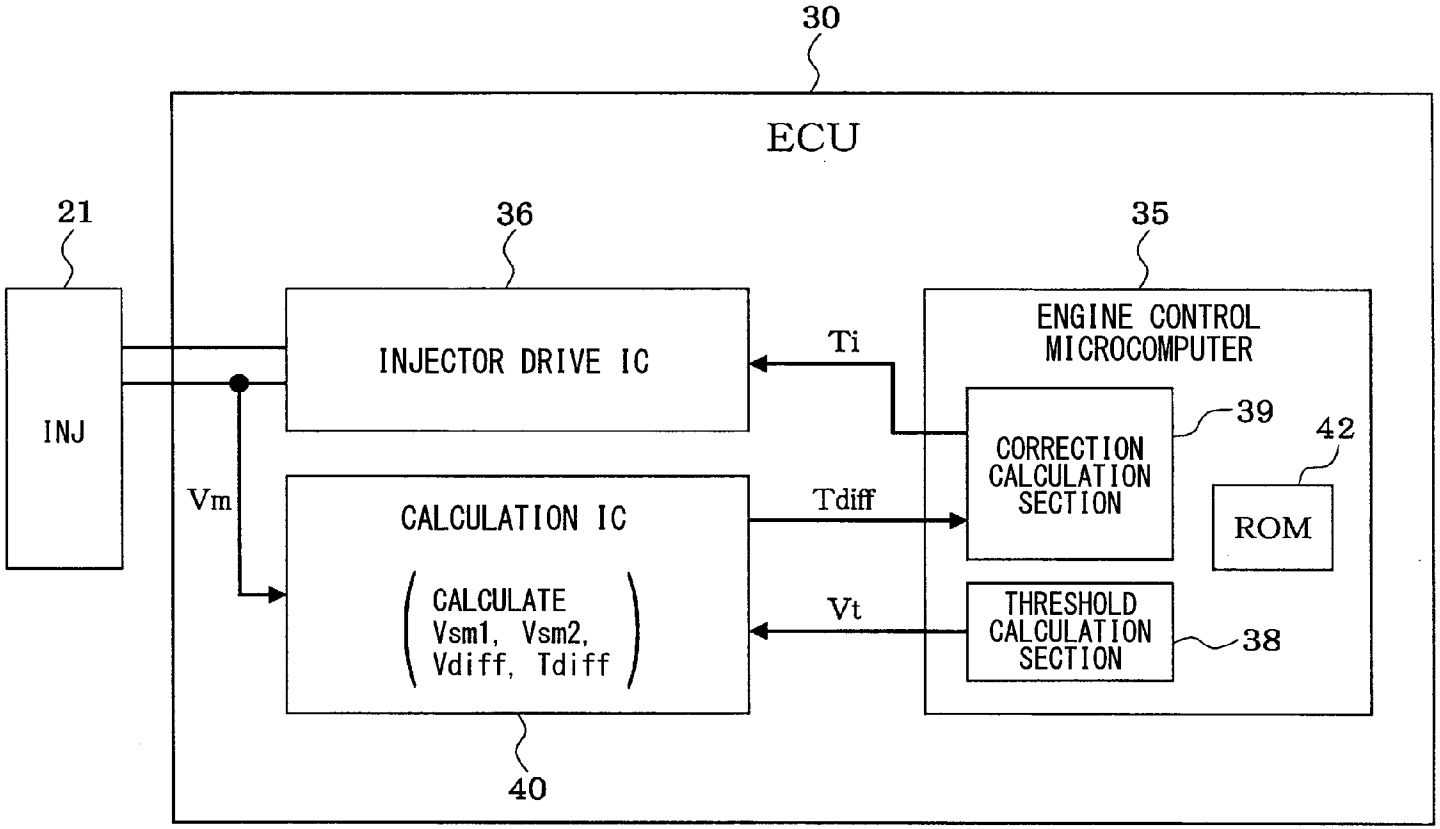
FIG. 32 is a block diagram illustrating a configuration of ECU of a ninth embodiment.

In the ninth embodiment, as illustrated in FIG. 32, the ECU 30 has a calculation IC 40 separately from the injector drive IC 36. The ECU 30, specifically the calculation IC 40, calculates a first filtered voltage Vsm1 and a second filtered voltage Vsm2 during the partial lift injection (at least after off of the injection pulse of the partial lift injection). Furthermore, the calculation IC 40 calculates the difference Vdiff between the first filtered voltage Vsm1 and the second filtered voltage Vsm2, and calculates time from a predetermined reference timing to a timing when the difference Vdiff exceeds the threshold Vt as the voltage inflection time Tdiff.

Alternatively, the calculation IC 40 calculates a third filtered voltage Vdiff.sm3 and a fourth filtered voltage Vdiff.sm4. Furthermore, the calculation IC 40 may calculate the difference between the third filtered voltage Vdiff.sm3 and the fourth filtered voltage Vdiff.sm4 as a second order differential Vdiff2, and calculate time from a predetermined reference timing to a timing when the second order differential Vdiff2 has an extreme value as the voltage inflection time Tdiff.

In such a case, the calculation IC 40 collectively serves as the filtered-voltage acquisition means, the difference calculation means, and the time calculation means.

In the ninth embodiment, the calculation IC 40 provided separately from the injector drive IC 36 collectively serves as the filtered-voltage acquisition means, the difference calculation means, and the time calculation means. Hence, while each of the specifications of the injector drive IC 36 and the engine control microcomputer 35 is not modified, the functions of the filtered-voltage acquisition means, the difference calculation means, and the time calculation means can be achieved only by adding the calculation IC 40. In addition, a calculation load of the engine control microcomputer 35 can be reduced thereby.

Tenth Embodiment

A tenth embodiment of the disclosure is now described with reference to FIG. 33. However, portions substantially the same as those in the first embodiment are not or briefly described, and differences from the first embodiment are mainly described.

Figure 33:
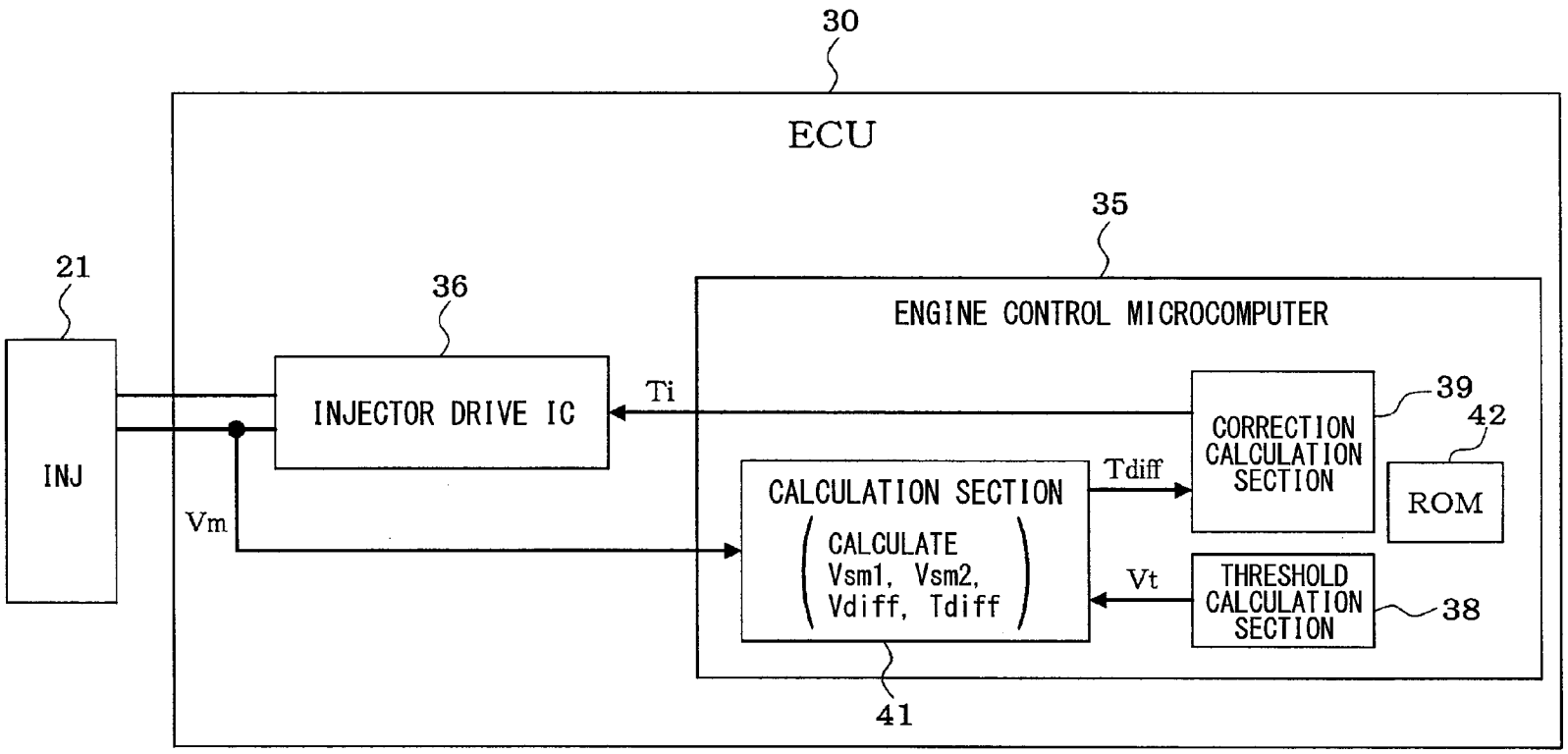
FIG. 33 is a block diagram illustrating a configuration of ECU of a tenth embodiment.

In the tenth embodiment, as illustrate in FIG. 33, the ECU 30, specifically a calculation section 41 of the engine control microcomputer 35, calculates a first filtered voltage Vsm1 and a second filtered voltage Vsm2 during the partial lift injection (at least after off of the injection pulse of the partial lift injection). Furthermore, the calculation section 41 calculates the difference Vdiff between the first filtered voltage Vsm1 and the second filtered voltage Vsm2, and calculates time from a predetermined reference timing to a timing when the difference Vdiff exceeds the threshold Vt as the voltage inflection time Tdiff.

Alternatively, the calculation section 41 calculates a third filtered voltage Vdiff.sm3 and a fourth filtered voltage Vdiff.sm4. Furthermore, the calculation section 41 may calculate the difference between the third filtered voltage Vdiff.sm3 and the fourth filtered voltage Vdiff.sm4 as a second order differential Vdiff2, and calculate time from a predetermined reference timing to a timing when the second order differential Vdiff2 has an extreme value as the voltage inflection time Tdiff.

In such a case, the engine control microcomputer 35 (the calculation section 41) collectively serves as the filtered-voltage acquisition means, the difference calculation means, and the time calculation means.

In the tenth embodiment, the engine control microcomputer 35 (the calculation section 41) collectively serves as the filtered-voltage acquisition means, the difference calculation means, and the time calculation means. Hence, the functions of the filtered-voltage acquisition means, the difference calculation means, and the time calculation means can be achieved only by modifying the specification of the engine control microcomputer 35 in the ECU 30.

In the first to tenth embodiments, the voltage inflection time Tdiff is continuously calculated during the partial lift injection (at least after off of the injection pulse of the partial lift injection). This however is not limitative. For example, the voltage inflection time Tdiff may be calculated when a predetermined performance condition (see step 202 of FIG. 13) is satisfied during the partial lift injection.

Although a digital filter is used as each of the first to fourth low-pass filters in the first to tenth embodiments, this is not limitative, and an analog filter may be used as such a low-pass filter.

Although a negative terminal voltage of the fuel injection valve 21 is used to calculate the voltage inflection time in the first to tenth embodiments, this is not limitative, and a positive terminal voltage of the fuel injection valve 21 may be used to calculate the voltage inflection time.

In addition, the disclosure may be practically applied to a system having a fuel injection valve for intake port injection without being limited to the system having the fuel injection valve for in-cylinder injection.

Although the disclosure has been described with some embodiments, it will be understood that the disclosure is not limited to the embodiments and the relevant structures. The disclosure includes various modifications and various transformations within the equivalent scope. In addition, various combinations and modes, and other combinations and modes containing at least or at most one component added thereto are also contained within the category or the scope of the technical idea of the disclosure.

The invention claimed is:

1. A fuel injection control system of an internal combustion engine having an electromagnetic driving fuel injection valve, the fuel injection control system comprising:

an injection control portion that performs full lift injection to drive the fuel injection valve to open with an injection pulse allowing a lift amount of a valve element of the fuel injection valve to reach a full lift position, and performs partial lift injection to drive the fuel injection valve to open with an injection pulse allowing the lift amount of the valve element not to reach the full lift position;

a filtered-voltage acquisition portion that, after off of the injection pulse of the partial lift injection, acquires a first filtered voltage being a terminal voltage of the fuel injection valve filtered by a first low-pass filter having a first frequency as a cutoff frequency, the first frequency being lower than a frequency of a noise component, and acquires a second filtered voltage being the terminal voltage filtered by a second low-pass filter having a second frequency as a cutoff frequency, the second frequency being lower than the first frequency;

a difference calculation portion that calculates a difference between the first filtered voltage and the second filtered voltage;

a time calculation portion that calculates time from a predetermined reference timing to a timing when the difference has an inflection point as voltage inflection time; and an injection pulse correction portion that corrects the injection pulse of the partial lift injection based on the voltage inflection time, wherein the injection pulse correction portion has a storage portion that beforehand stores a relationship between the voltage inflection time and the injection quantity for each of a plurality of injection pulse widths each providing the partial lift injection, and calculates a required injection pulse width corresponding to a required injection quantity based on the relationship between the voltage inflection time and the injection quantity, the relationship being beforehand stored in the storage portion for each of the injection pulse widths, and based on the voltage inflection time calculated by the time calculation portion.

2. The fuel injection control system of the internal combustion engine according to claim 1, wherein the injection pulse correction portion uses the relationship between the voltage inflection time and the injection quantity, the relationship being beforehand stored in the storage portion, to estimate an injection quantity corresponding to the voltage inflection time calculated by the time calculation portion for each of the injection pulse widths, sets a relationship between the injection pulse width and the injection quantity based on a result of such estimation, and uses the relationship between the injection pulse width and the injection quantity to calculate the required injection pulse width corresponding to the required injection quantity.

3. The fuel injection control system of the internal combustion engine according to claim 1, wherein the injection pulse correction portion calculates an average of values of voltage inflection time of all cylinders calculated by the time calculation portion to calculate a deviation between the voltage inflection time of each of the cylinders and the average for each of the cylinders, calculates an injection correction amount based on the deviation and the relationship between the voltage inflection time and the injection quantity, the relationship being beforehand stored in the storage portion, and calculates, using the injection correction amount, the required injection pulse width corresponding to the required injection quantity.

4. The fuel injection control system of the internal combustion engine according to claim 1, wherein the injection pulse correction portion uses a primary expression approximating the relationship between the voltage inflection time and the injection quantity as a representation of the relationship between the voltage inflection time and the injection quantity.

5. The fuel injection control system of the internal combustion engine according to claim 4, wherein the storage portion stores a slope and an intercept of the primary expression for each of the injection pulse widths.

6. The fuel injection control system of the internal combustion engine according to claim 5, wherein the storage portion further stores the slope and the intercept of the primary expression for each of fuel pressures.

7. The fuel injection control system of the internal combustion engine according to claim 1, wherein the injection pulse correction portion uses a quadratic or higher polynomial approximating the relationship between the voltage inflection time and the injection quantity as a representation of the relationship between the voltage inflection time and the injection quantity.

8. The fuel injection control system of the internal combustion engine according to claim 7, wherein the storage portion stores constants of terms of the polynomial for each of the injection pulse widths.

9. The fuel injection control system of the internal combustion engine according to claim 8, wherein the storage portion further stores the constants of the terms of the polynomial for each of fuel pressures.

10. The fuel injection control system of the internal combustion engine according to claim 1, wherein the injection pulse correction portion corrects the injection pulse for each of cylinders.

11. The fuel injection control system of the internal combustion engine according to claim 1, wherein the injection pulse correction portion corrects the injection pulse using the voltage inflection time calculated by the time calculation portion when the partial lift injection is performed with one typical injection pulse width among injection pulse widths each providing the partial lift injection.

12. The fuel injection control system of the internal combustion engine according to claim 11, wherein the typical injection pulse width provides an injection quantity half the injection quantity corresponding to a boundary of the partial lift injection and the full lift injection.

13. The fuel injection control system of the internal combustion engine according to claim 1, wherein the time calculation portion calculates the voltage inflection time with a timing when the difference exceeds a predetermined threshold as the timing when the difference has the inflection point.

14. The fuel injection control system of the internal combustion engine according to claim 1, wherein the filtered-voltage acquisition portion acquires a third filtered voltage being the difference filtered by a third low-pass filter having a third frequency as a cutoff frequency, the third frequency being lower than a frequency of a noise component, and acquires a fourth filtered voltage being the difference filtered by a fourth low-pass filter having a fourth frequency as the cutoff frequency, the fourth frequency being lower than the third frequency, wherein the difference calculation portion calculates a difference between the third filtered voltage and the fourth filtered voltage as a second order differential, and wherein the time calculation portion calculates the voltage inflection time with a timing when the second order differential has an extreme value as the timing when the difference has the inflection point.

15. The fuel injection control system of the internal combustion engine according to claim 14, wherein when the second order differential no longer increases, the time calculation portion determines the second order differential has the extreme value.

16. The fuel injection control system of the internal combustion engine according to claim 1, further comprising a modification portion that determines a fuel property based on the voltage inflection time calculated by the time calculation portion during the partial lift injection, and modifies an injection characteristic of the fuel injection valve for calculation of the injection pulse depending on the fuel property.

17. The fuel injection control system of the internal combustion engine according to claim 16, wherein the modification portion modifies the injection characteristic of the fuel injection valve used for calculation of the injection pulse when a variation amount of the voltage inflection time between before and after fuel supply has a value equal to or higher than a predetermined value.

18. The fuel injection control system of the internal combustion engine according to claim 17, wherein the modification portion uses, as the variation amount of the voltage inflection time between before and after fuel supply, a difference between voltage inflection time immediately before or immediately after current fuel supply and voltage inflection time after lapse of a predetermined period from the current fuel supply, or a difference between voltage inflection time after lapse of a predetermined period from previous fuel supply and voltage inflection time after lapse of a predetermined period from the current fuel supply.

* * * * *